US011079709B2

(12) United States Patent
Sakurai et al.

(10) Patent No.: US 11,079,709 B2
(45) Date of Patent: Aug. 3, 2021

(54) IMAGE FORMING APPARATUS

(71) Applicant: FUJIFILM Business Innovation Corp., Tokyo (JP)

(72) Inventors: Yusuke Sakurai, Kanagawa (JP); Hideki Sato, Kanagawa (JP); Jun Sawamura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 218 days.

(21) Appl. No.: 16/172,890

(22) Filed: Oct. 29, 2018

(65) Prior Publication Data

US 2019/0369543 A1 Dec. 5, 2019

(30) Foreign Application Priority Data

May 30, 2018 (JP) ..... JP2018-103324

(51) Int. Cl.
*G03G 15/00* (2006.01)
*G03G 15/20* (2006.01)

(52) U.S. Cl.
CPC ..... *G03G 15/6576* (2013.01); *G03G 15/2028* (2013.01)

(58) Field of Classification Search
CPC ..... G03G 2215/00675; G03G 15/6576; G03G 2215/00662

(Continued)

(56) References Cited

U.S. PATENT DOCUMENTS 5,237,381 A * 8/1993 Hamada ..... B65H 23/34 399/406
9,811,043 B2 * 11/2017 Mimbu ..... G03G 15/6558
(Continued)

FOREIGN PATENT DOCUMENTS

JP 62283374 A * 12/1987
JP 2004026419 A * 1/2004
(Continued)

*Primary Examiner* — Jennifer Bahls
(74) *Attorney, Agent, or Firm* — JCIPRNET

(57) ABSTRACT

An image forming apparatus includes a fixing unit that transports a sheet of paper carrying an unfixed image through a nip part to fix the unfixed image to the sheet, the nip part applying heat and pressure to the sheet, a first guide unit that guides transport of the sheet, the first guide unit coming into contact with a first side of the sheet leaving the nip part of the fixing unit, and a second guide unit that guides transport of the sheet, the second guide unit coming into contact with a second side of the sheet leaving the nip part of the fixing unit, the second guide unit being rotatable, the second side being opposite to the first side. The first guide unit has a guide part. The guide part includes an upstream guide part disposed upstream with respect to a sheet transport direction, and a bent guide part that is bent at an endpoint position of the upstream guide part in a direction of entry into a sheet transport passage relative to the upstream guide part. At least one portion of the second guide unit is disposed to face the bent guide part such that the at least one portion of the second guide unit is positioned within an area corresponding to a portion of the bent guide part from an upstream end to a downstream end with respect to the sheet transport direction, with a space being provided between the at least one portion of the second guide unit and the bent guide part to allow passage of the sheet.

17 Claims, 14 Drawing Sheets

(58) Field of Classification Search
USPC ..... 399/406
See application file for complete search history.

(56) References Cited

U.S. PATENT DOCUMENTS

| | | | | |
|---|---|---|---|---|
| 2003/0147681 | A1* | 8/2003 | Suenaga | G03G 15/2028 399/406 |
| 2008/0145124 | A1* | 6/2008 | Ruiz | G03G 15/6573 399/406 |

FOREIGN PATENT DOCUMENTS

| | | |
|---|---|---|
| JP | 2006168940 | 6/2006 |
| JP | 2009214975 | 9/2009 |
| JP | 2016173500 | 9/2016 |

* cited by examiner

IMAGE FORMING APPARATUS

CROSS-REFERENCE TO RELATED APPLICATIONS

This application is based on and claims priority under 35 USC 119 from Japanese Patent Application No. 2018-103324 filed May 30, 2018.

BACKGROUND

(i) Technical Field

The present disclosure relates to an image forming apparatus.

(ii) Related Art

For example, Japanese Unexamined Patent Application Publications Nos. 2006-168940, 2009-214975, and 2016-173500 describe examples of image forming apparatuses according to related art that are equipped with a function to correct curl (deformation such as curving or warping) occurring in a sheet of paper discharged from a fixing unit.

Japanese Unexamined Patent Application Publication No. 2006-168940 discloses an image forming apparatus described below. The image forming apparatus includes a first transport part that rotates in contact with a sheet of paper transported from a fixing device or other components, a second transport part whose low-hardness portion lower in hardness than the first transport part is disposed in pressure contact with the first transport part, the second transport part rotating in contact with an incoming sheet, and a guide member located downstream, relative to the direction of sheet transport, of a nip part formed by pressure contact between the first transport part and the second transport part, the guiding member guiding a curled sheet in a decurling direction. The location of the nip part with respect to the sheet transport direction is variable (movable) in accordance with the rigidity of an incoming sheet that comes into contact with the guide member.

Japanese Unexamined Patent Application Publication No. 2006-168940 also describes that one of the first transport part and the second transport part is positioned on the same side as the guide member due to its own weight, and this transport part is movable in a direction opposite from the guide member about the center of rotation of the other transport part.

Further, Japanese Unexamined Patent Application Publication No. 2006-168940 also describes that, if the sheet passing through the pressure contact area between the two transport parts is a heavy paper sheet, which is relatively resistant to curling, one of the first and second transport parts that is movable moves in the direction opposite from the guide member such that the sheet leaving the pressure contact area is introduced to the guide member at a greater angle than when the sheet introduced to the guide member is a thin paper sheet, which is more prone to curling.

Japanese Unexamined Patent Application Publication No. 2009-214975 discloses an image forming apparatus including a decurling device described below. The decurling device includes two driving rollers to transport a sheet of paper discharged from a fixing part, and a single driven roller that comes into contact with the driving rollers. The decurling device corrects curl present in an incoming sheet based on the pressing force exerted by the driving rollers and the driven roller and the shape of turn. To enable the driven roller to move into and out of contact with one of the driving rollers upon receiving the force with which the paper is transported, the driven roller is supported onto the other driving roller in a manner that allows its swinging movement.

Japanese Unexamined Patent Application Publication No. 2016-173500 discloses an image forming apparatus including a back-curl correction mechanism disposed in the transport path between a fixing device and a recording-sheet-transport-path branching unit. The back-curl correction mechanism includes an auxiliary nip part, a guide member, and a guide-member moving unit. The auxiliary nip part is formed by a driving roller and a driven roller to apply pressing force to a sheet of recording paper for auxiliary transport of the sheet. The driving roller is disposed on the same side as the side toward which the back curl develops in the recording sheet at the fixing nip part of the fixing device. The driven roller is disposed on the same side as where heat is applied to the recording sheet. The guide member is disposed on the same side as the driving roller to guide the recording sheet. The guide-member moving unit moves the guide member to one of a first position and a second position. In the first position, the guide member applies required pressing force to the recoding paper passing through the auxiliary nip part. In the second position, the guide member is positioned away from the recording sheet.

Japanese Unexamined Patent Application Publication No. 2016-173500 also describes moving the guide member to the second position if the recording sheet is a heavy paper sheet.

SUMMARY

Aspects of non-limiting embodiments of the present disclosure relate to an image forming apparatus capable of correcting curl in a sheet of paper discharged from the nip part of a fixing unit, without performing a special operation in accordance with the basis weight of the sheet.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including a fixing unit that transports a sheet of paper carrying an unfixed image through a nip part to fix the unfixed image to the sheet, the nip part applying heat and pressure to the sheet, a first guide unit that guides transport of the sheet, the first guide unit coming into contact with a first side of the sheet leaving the nip part of the fixing unit, and a second guide unit that guides transport of the sheet, the second guide unit coming into contact with a second side of the sheet leaving the nip part of the fixing unit, the second guide unit being rotatable, the second side being opposite to the first side. The first guide unit has a guide part. The guide part includes an upstream guide part disposed upstream with respect to a sheet transport direction, and a bent guide part that is bent at an endpoint position of the upstream guide part in a direction of entry into a sheet transport passage relative to the upstream guide part. At least one portion of the second guide unit is disposed to face the bent guide part such that the at least one portion of the second guide unit is positioned within an area corresponding to a portion of the bent guide part from an upstream end to a downstream end with respect to the sheet transport direction, with a space being provided between the at least one portion of the second guide unit and the bent guide part to allow passage of the sheet.

BRIEF DESCRIPTION OF THE DRAWINGS

Exemplary embodiments of the present disclosure will be described in detail based on the following figures, wherein.

DETAILED DESCRIPTION

Hereinafter, exemplary embodiments of the present disclosure will be described with reference to the drawings.

Exemplary Embodiment 1

Figure 1:
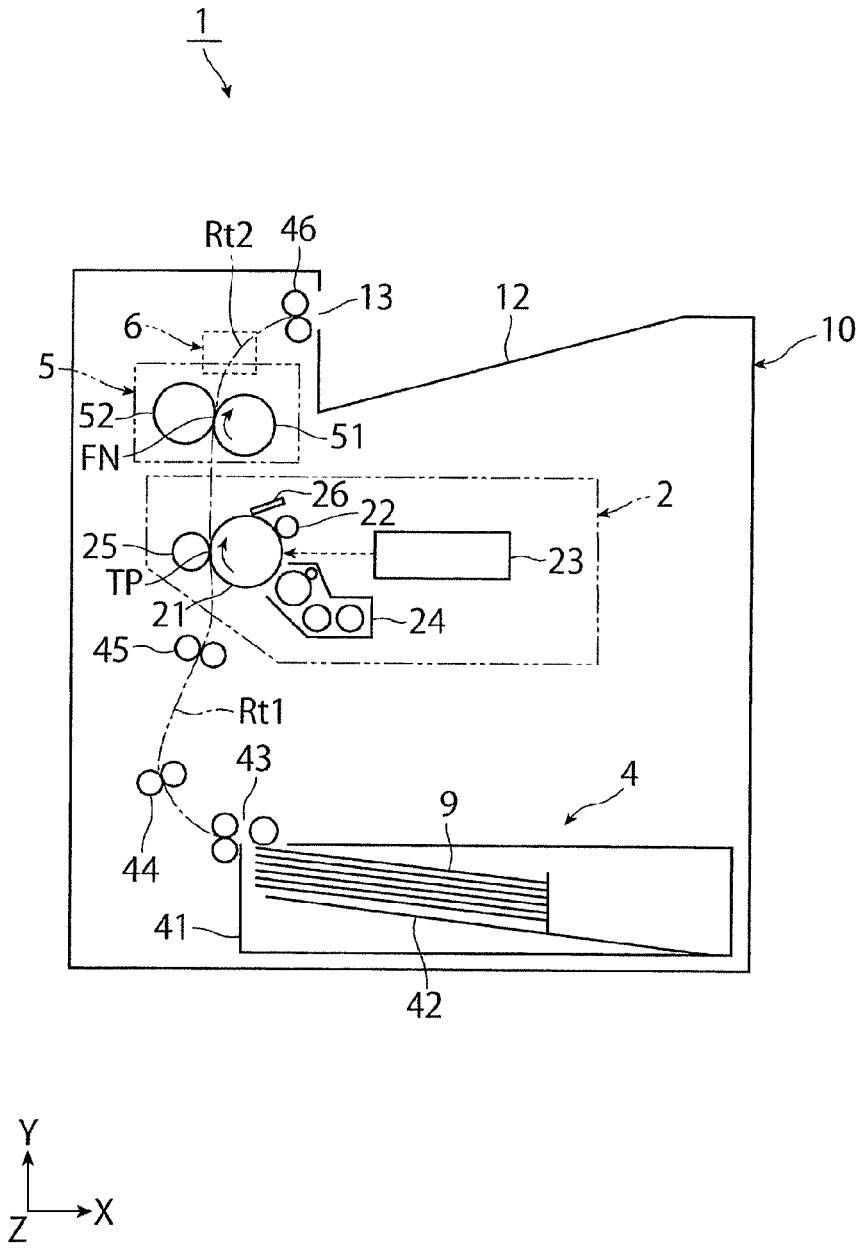
FIG. 1 schematically illustrates the general arrangement of an image forming apparatus according to Exemplary Embodiment 1.
Figure 2:
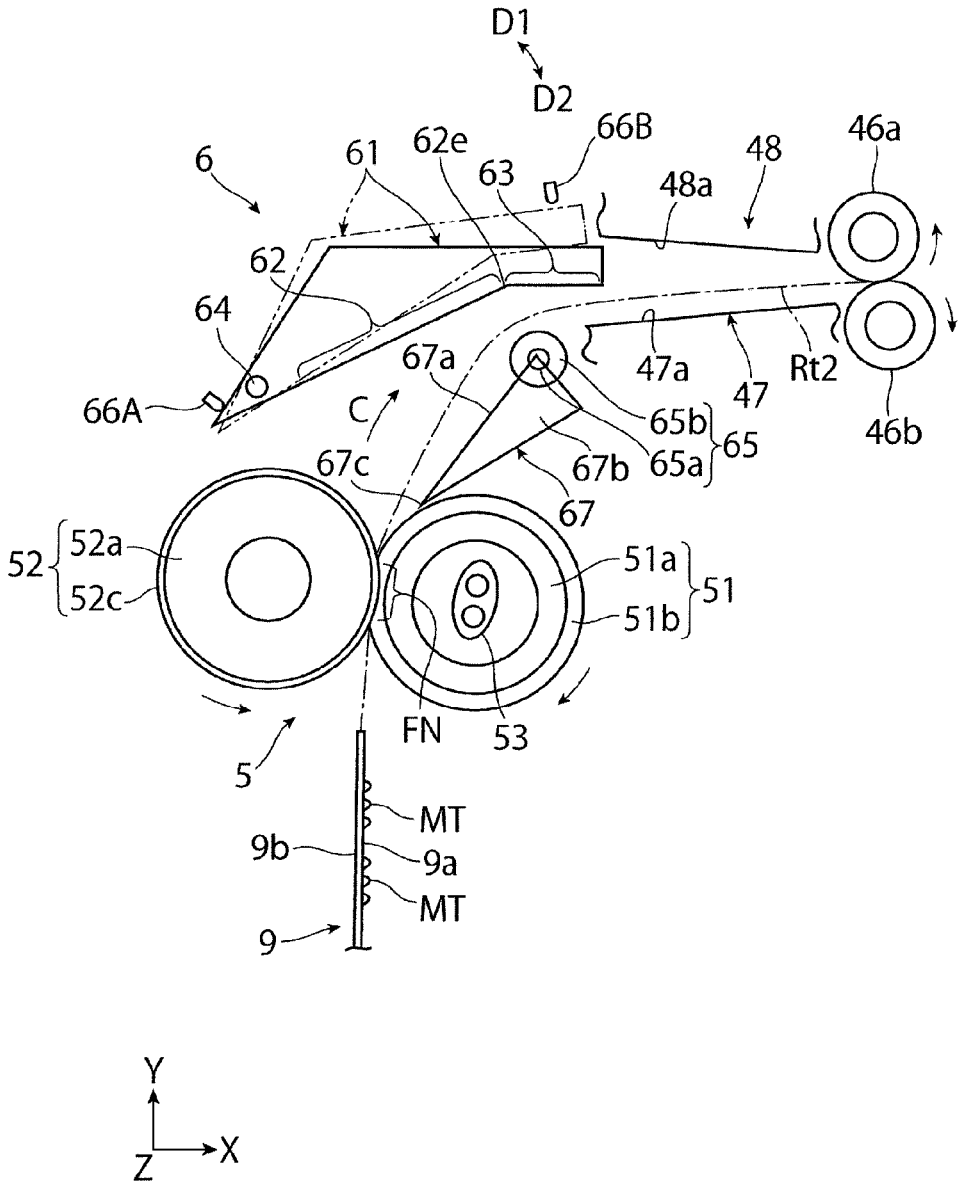
FIG. 2 schematically illustrates a portion (mostly a fixing part and a decurling part) of the image forming apparatus illustrated in FIG. 1.

FIGS. 1 and 2 illustrate an image forming apparatus 1 according to Exemplary Embodiment 1. FIG. 1 illustrates the configuration of the entire image forming apparatus 1, and FIG. 2 illustrates the configuration of a portion (mostly a fixing part and a decurling part) of the image forming apparatus 1.

Arrows denoted as X, Y, and Z in each figure respectively represent the width, height, and depth directions of a three-dimensional space assumed for the figure. In figures such as FIGS. 1 and 2, the hollow circle at the intersection of the X- and Y-direction arrows indicates that the Z-direction is oriented downward in the direction perpendicular to the plane of the figures.

Overall Configuration of Image Forming Apparatus

The image forming apparatus 1 is implemented as, for example, a printer that forms an image on a sheet 9 of paper based on externally input image information.

As illustrated in FIG. 1, the image forming apparatus 1 includes, for example, the following components disposed in the space inside a housing 10: an image forming part 2 that forms an unfixed image based on image information and transfers the unfixed image to the sheet 9; a paper feed part 4 that accommodates the sheet 9 to be supplied to the image forming part 2; a fixing part 5 that fixes, to the sheet 9, an unfixed image that has been transferred by the image forming part 2; and a decurling part 6 that corrects curl in the sheet 9 discharged from the fixing part 5. The alternate long and short dash line in FIG. 1 and other figures indicates a major transport path along which the sheet 9 is transported inside the housing 10.

Image information refers to information related to an image, such as a character, a geometric figure, a photograph, or a pattern. The housing 10 is a structure constructed of various types of support members, covering materials, or other components formed into a required shape. The housing 10 has, at a portion of its top surface, a paper output receiving part 12 in which each sheet 9 discharged after having an image formed thereon is received in a stacked manner, and a paper eject port 13 through which the sheet 9 is discharged toward the paper output receiving part 12.

In the image forming part 2, for example, the following devices related to an electrophotographic system are disposed around a photoconductor drum 21, which is an example of a photoconductor that rotates as indicated by the arrow.

Examples of the above-mentioned devices include a charging device 22, an exposure device 23, a developing device 24, a transfer device 25, and a cleaning device 26. The charging device 22 electrically charges the outer peripheral surface (surface on which an image can be formed) of the photoconductor drum 21. The exposure device 23 exposes the outer peripheral surface of the photoconductor drum 21 to light based on image information to thereby form an electrostatic latent image on the outer peripheral surface of the photoconductor drum 21. The developing device 24 develops an electrostatic latent image formed on the outer peripheral surface of the photoconductor drum 21 into a visible image by use of developer (toner). The transfer device 25 transfers an unfixed image (toner image) formed on the outer peripheral surface of the photoconductor drum 21 to the sheet 9. The cleaning device 26 cleans away unwanted substances such as toner or paper dust adhering to the outer peripheral surface of the photoconductor drum 21. In the image forming part 2, the area where the photoconductor drum 21 and the transfer device 25 contact or face each other serves as a transfer position TP through which the sheet 9 is passed to transfer an unfixed toner image to the sheet 9.

In the paper feed part 4, for example, devices such as an accommodating cassette 41 and a feeding device 43 are disposed. The paper feed part 4 is disposed at a positon inside the housing 10 below the image forming part 2.

Of the above-mentioned devices, the accommodating cassette 41, which has a loading plate 42 to receive a stack of multiple sheets 9 loaded in a required orientation, is an accommodating member that can be drawn out to the outside of the housing 10. The feeding device 43 pays out the stack of sheets 9 loaded on the loading plate 42 of the accommodating cassette 41 one by one, beginning with the uppermost sheet of the stack by means of multiple rollers or other components.

As illustrated in FIGS. 1 and 2, the fixing part 5 is a portion (fixing unit) of the image forming apparatus 1 where devices such as a heat rotator 51 and a pressure rotator 52 are disposed in the space inside a housing (not illustrated) having areas such as an entry and exit for the sheet 9. The fixing part 5 is disposed at a position inside the housing 10 above the transfer position TP of the image forming part 2.

Of the above-mentioned devices, the heat rotator 51 constitutes a portion of a fixing unit that is in the form of, for example, a roller that rotates as indicated by the arrow. For example, the heat rotator 51 is heated by a heat source 53 disposed inside the heat rotator 51 such that the heat rotator 51 is kept at a required temperature. The pressure rotator 52 constitutes a portion of a fixing unit that is in the form of, for example, a roller that contacts the heat rotator 51 under a required applied pressure so as to rotate following the rotation of the heat rotator 51.

In the fixing part 5, the area where the heat rotator 51 and the pressure rotator 52 contact defines a nip part (fixing processing part) FN. In the nip part FN, the sheet 9 with a transferred unfixed toner image is subjected to heat and pressure for a fixing process.

The fixing part 5 discharges the sheet 9 from the nip part FN after a fixing process, in a substantially upward direction (e.g., in a direction (vertically upward direction) opposite to the direction of gravity and falling within a range of ±45 degrees to the direction of gravity). In the following description, the fixing part 5 that discharges a sheet in this manner will be sometimes also referred to as "upward discharge-type fixing part 5A".

As illustrated in FIG. 1, the image forming apparatus 1 includes a paper feed transport path Rt1 disposed between the paper feed part 4 and the image forming part 2 to feed and transport the sheet 9 accommodated in the paper feed part 4 to the transfer position TP of the image forming part 2. The paper feed transport path Rt1 is provided with components such as a pair of transport rollers 44 and a pair of transport rollers 45, which each pinch and transport the sheet 9, and a guide member (not illustrated) that provides a transport space for the sheet 9 to guide the transport of the sheet 9.

Further, a discharge transport path Rt2 is positioned between the fixing part 5 and the paper output receiving part 12 to transport the sheet 9 that has undergone a fixing process so that the sheet 9 is discharged to the paper output receiving part 12 and then received in the paper output receiving part 12. The discharge transport path Rt2 is provided with components such as a pair of discharge rollers 46 and a guide member (not illustrated). The pair of discharge rollers 46 pinches and transports the sheet 9 at a position in front of the paper eject port 13, which is provided in a wall surface constituting a portion of the paper output receiving part 12 of the housing 10. The guide member provides a transport space for the sheet 9 to guide the transport of the sheet 9. The discharge transport path Rt2 defines a transport path that bends and extends upward from the fixing part 5 toward the pair of discharge rollers 46.

Image Forming Operation

The image forming apparatus 1 performs the following basic image forming operation.

First, when a controller (not illustrated) receives a command requesting for an image forming operation from an externally connected device or other devices, required portions of the image forming apparatus 1, such as those in the image forming part 2, the paper feed part 4, the fixing part 5, and other parts, activate at predetermined timing.

As illustrated in FIG. 1, in the image forming part 2, the photoconductor drum 21 starts to rotate in the direction indicated by the arrow. After the charging device 22 charges the outer peripheral surface of the photoconductor drum 21 to a required potential, the exposure device 23 irradiates the charged outer peripheral surface of the photoconductor drum 21 with light (indicated by the dashed arrow) corresponding to an image signal that has undergone image processing, thus forming an electrostatic latent image on the outer peripheral surface of the photoconductor drum 21. After this process, the developing device 24 supplies toner of a required color (e.g., black) serving as developer, so that the toner adheres to the electrostatic latent image through electrostatic action, thus developing the electrostatic latent image. A toner image of a required color corresponding to the electrostatic latent image is thus formed on the outer peripheral surface of the photoconductor drum 21.

Meanwhile, in the paper feed part 4, the sheet 9 accommodated in the accommodating cassette 41 is fed toward the transfer position TP of the image forming part 2 by the feeding device 43, in synchronization with the timing when an image forming operation is performed in the image forming part 2. At this time, the sheet 9 fed from the accommodating cassette 41 by the feeding device 43 of the paper feed part 4 is sent to the transport rollers 45, which are registration rollers, via the transport rollers 44 in the paper feed transport path Rt1. The sheet 9 is subsequently sent to the transfer position TP by the transport rollers 45 at required timing.

Then, at the transfer position TP of the image forming part 2, the transfer device 25 transfers a toner image formed on the photoconductor drum 21 to the sheet 9 fed from the paper feed part 4. Further, in the image forming part 2, the cleaning device 26 cleans away unnecessary substances that remain adhering to the outer peripheral surface of the photoconductor drum 21 after, for example, the transfer process.

Subsequently, the sheet 9 having the toner image transferred thereto in the image forming part 2 is discharged from the transfer position TP toward the fixing part 5. In the fixing part 5, the sheet 9 carrying the toner image is advanced through the nip part FN. Thus, in the nip part FN, the toner image on the sheet 9 is heated under applied pressure to melt, and then fixed to the sheet 9.

Lastly, after the fixing process, the sheet 9 is discharged from the fixing part 5. The sheet 9 is then transported via the discharge transport path Rt2 to the paper output receiving part 12 so that the sheet 9 is received in the paper output receiving part 12. At this time, after undergoing the fixing process and leaving the fixing part 5, the sheet 9 is transported to the discharge rollers 46 via the discharge transport path Rt2. The sheet 9 is then sent by the discharge rollers 46 to the outside of the housing 10 through the paper eject port 13, such that the sheet 9 is dropped to the paper output receiving part 12 and received in the paper output receiving part 12.

Through the series of processes mentioned above, an image of a required color is formed on one side of a single sheet 9, thus completing the basic image forming operation.

If the image forming apparatus 1 receives a command issued to request for an image forming operation on multiple sheets 9, the above-mentioned series of processes is repeated in the same manner for a number of times corresponding to the number of such sheets.

Curl Generated During Fixing Process

Figure 14A:
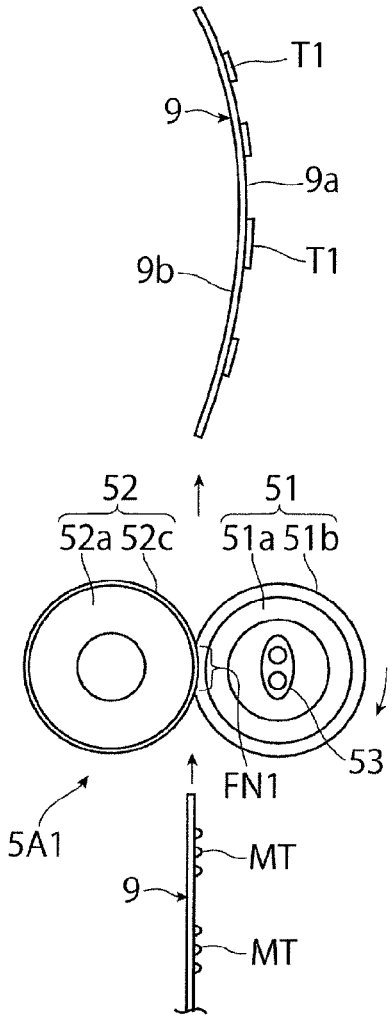
FIG. 14A schematically illustrates a fixing part with type-1 nip, and a sheet leaving the fixing part and having away-from-image curl.

As illustrated in FIG. 14A, in the image forming apparatus 1 described above, the sheet 9 may sometimes develop a curl described below after leaving the nip part FN of the fixing part (fixing unit) 5. The curl generated at this time (also called, for example, "away-from-image curl") results from deformation of the sheet 9 into a curved shape such that the sheet 9 warps toward a back side 9*b* opposite to a front side 9*a* carrying an image T1, which represents an image formed immediately after fixing of an unfixed image (toner image) MT.

This curl tends to occur, for example, when the following conditions exist: the fixing part 5 is implemented as a fixing unit having a nip part FN1 where the pressure rotator 52 bites into the surface of the heat rotator 51; and a plain paper sheet is used as the sheet 9.

As illustrated in FIG. 2 or 14A, the fixing part 5 according to Exemplary Embodiment 1 is a fixing part having the following configuration (e.g., the fixing part 5 with type-1 nip). That is, the fixing part 5 includes the heat rotator 51 having at least an elastic layer 51*b* disposed on the outer peripheral surface of a roller base 51*a* made of metal or other materials, and the pressure rotator 52 having a release layer 52*c* disposed on a roller base 52*a* made of metal or other materials. The heat rotator 51 and the pressure rotator 52 are used to form the nip part FN1 where the pressure rotator 52 bites into the elastic layer 51*b* of the heat rotator 51 and the elastic layer 51*b* becomes recessed as a result.

The fixing part 5 is the upward discharge-type fixing part 5A and is also the fixing part 5 with type-1 nip. Accordingly, the fixing part 5 will be hereinafter sometimes referred to as upward discharge-type fixing part 5A1 with type-1 nip. The term plain paper sheet as used herein refers to a sheet of paper that is neither thin paper nor heavy paper, with a basis weight in the range of, for example, 60 to 105 g/m$^2$.

If the upward discharge-type fixing part 5A1 with type-1 nip is used to perform a fixing process with a heavy paper sheet (e.g., a sheet of paper with a basis weight of 106 g/m$^2$ or more) used as the sheet 9, the away-from-image curl mentioned above does not occur in the heavy paper sheet. In this case, the heavy paper sheet may sometimes develop a curl (also called, for example, "toward-image curl") such that the heavy paper sheet is deformed so as to curve toward the side carrying an image formed immediately after fixing of an unfixed image.

Figure 14B:
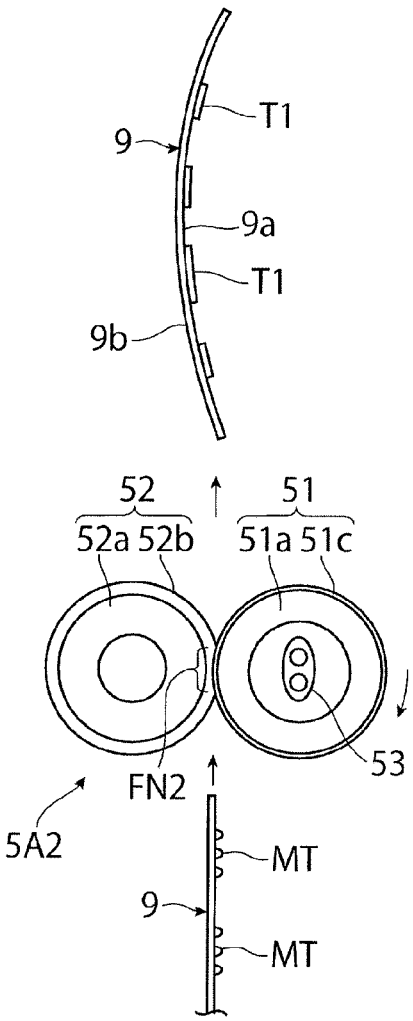
FIG. 14B schematically illustrates a fixing part with type-2 nip, and a sheet leaving the fixing part and having toward-image curl.

In this regard, as illustrated in FIG. 14B, the toward-image curl mentioned above tends to form also when, for example, the following conditions exist: the fixing part 5 is implemented as a fixing unit having a nip part FN2 where the heat rotator 51 bites into the surface of the pressure rotator 52; and a plain paper sheet is used as the sheet 9.

Figure 12:
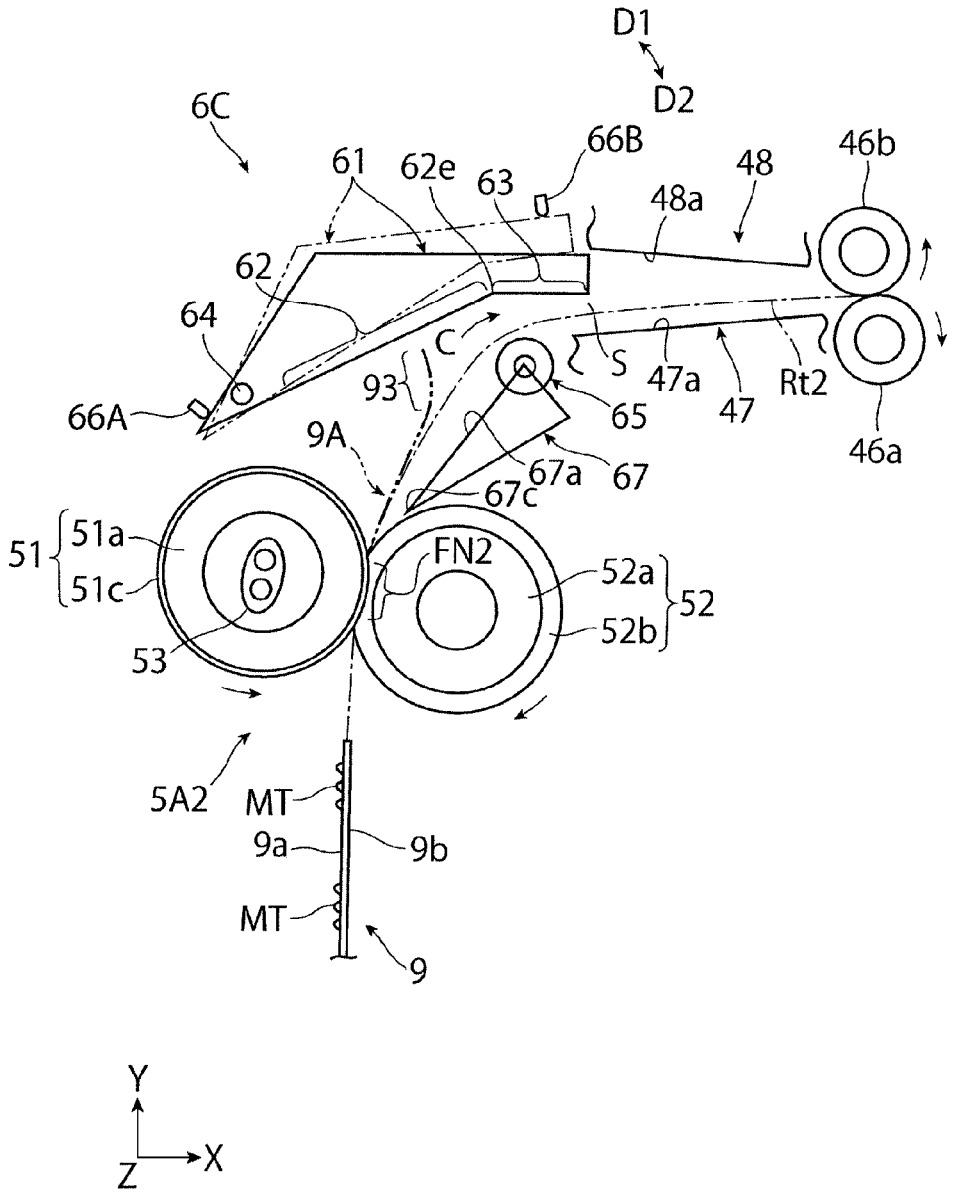
FIG. 12 schematically illustrates another exemplary configuration of a fixing part and a decurling part.

As illustrated in FIG. 12 or 14B, the fixing part 5 in this case is a fixing part having the following configuration (e.g., the fixing part 5 with type-2 nip). That is, the fixing part 5 includes the heat rotator 51 having a release layer 51*c* disposed on the outer peripheral surface of the roller base 51*a* made of metal or other materials, and the pressure rotator 52 having an elastic layer 52*b* disposed on the roller base 52*a* made of metal or other materials. The heat rotator 51 and the pressure rotator 52 are used to form the nip part FN2 where the heat rotator 51 bites into the elastic layer 52*b* of the pressure rotator 52 and the elastic layer 52*b* becomes recessed as a result. The fixing part 5 is the upward discharge-type fixing part 5A and is also the fixing part 5 with type-2 nip. Accordingly, the fixing part 5 will be hereinafter sometimes referred to as upward discharge-type fixing part 5A2 with type-2 nip.

If the upward discharge-type fixing part 5A2 with type-2 nip is used to perform a fixing process with a heavy paper sheet used as the sheet 9, the heavy paper sheet may sometimes develop the toward-image curl mentioned above, although the degree of curvature occurring in the sheet 9 in this case is not as great as the degree of curvature that would occur in a plain paper sheet.

Detailed Configuration of Image Forming Apparatus (Decurling Part)

To address the above-mentioned curling, the image forming apparatus 1 includes the decurling part (decurling device) 6 having the configuration described below.

Figure 3:
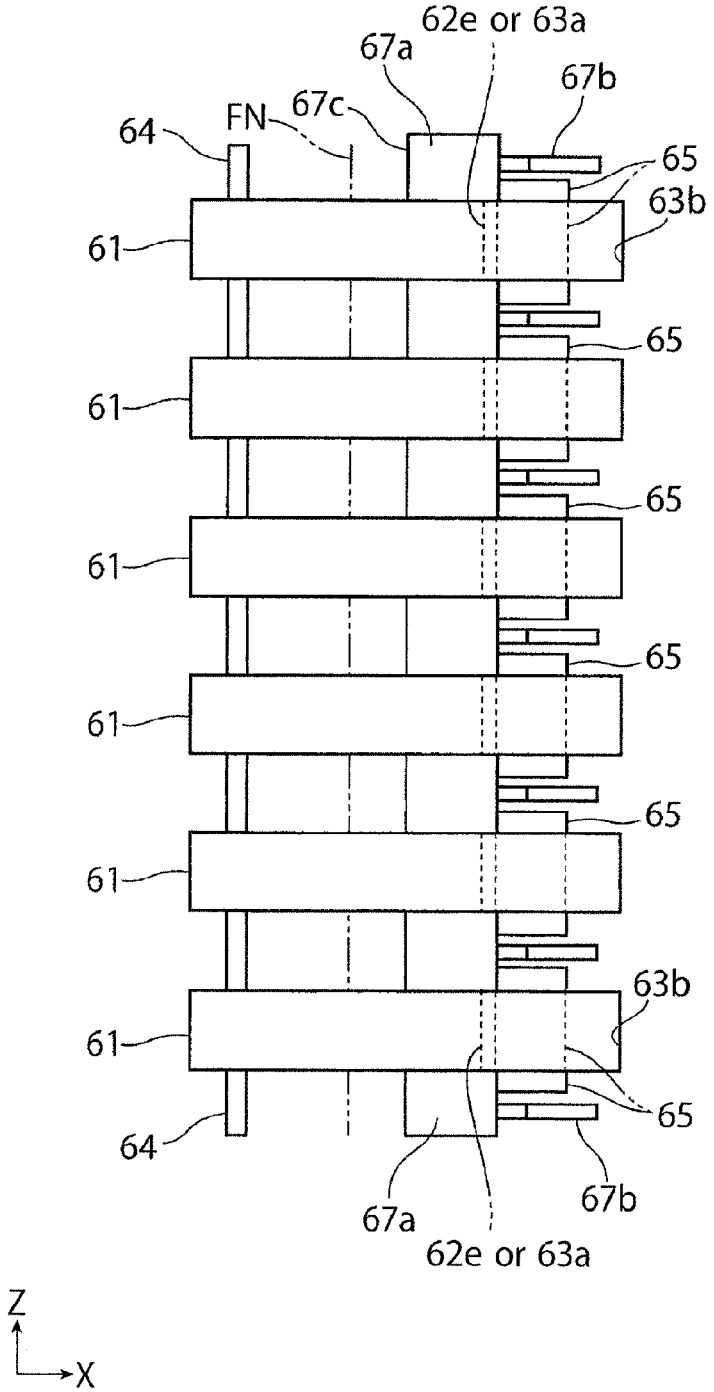
FIG. 3 schematically illustrates the decurling part illustrated in FIG. 2 as seen from above.
Figure 4:
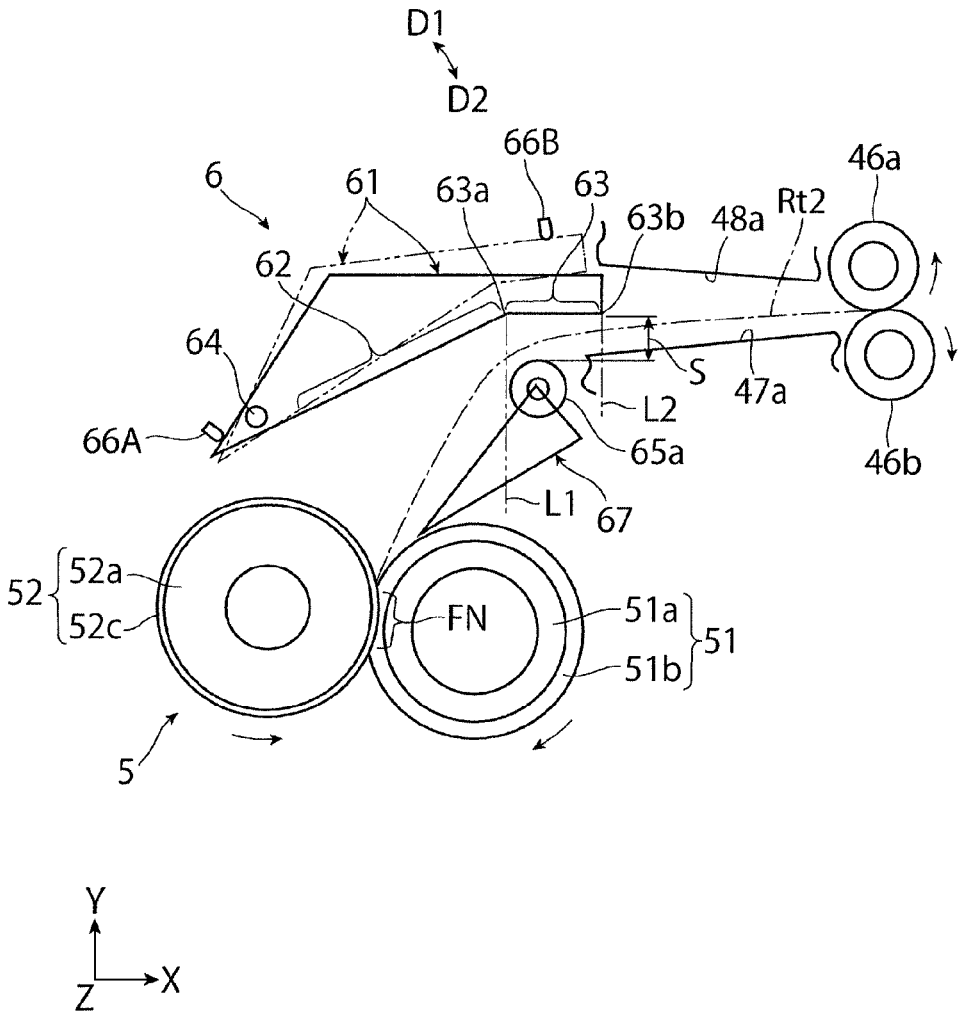
FIG. 4 schematically illustrates the configuration of the decurling part illustrated in FIG. 2.

As illustrated in FIGS. 2 to 4 or other figures, the decurling part 6 includes a first guide unit 61, and a rotatable second guide unit 65. The first guide unit 61 comes into contact with the back side 9*b* of the sheet 9 leaving the nip part FN of the fixing part 5 to thereby guide the transport of the sheet 9. The second guide unit 65 comes into contact with the front side 9*a* opposite to the back side 9*b* of the sheet 9 leaving the nip part FN of the fixing part 5 to thereby guide the transport of the sheet 9.

The back side 9*b* of the sheet 9 refers to one side of the sheet 9 toward which a curl to be corrected is curved. The front side 9*a* of the sheet 9 refers to the side of the sheet 9 opposite to the back side 9*b* and toward which the sheet 9 is bent for decurling. When viewed from the fixing part 5, with respect to the nip part FN, the first guide unit 61 is disposed to lie mostly on the same side as the pressure rotator 52. By contrast, also with respect to the nip part FN, the second guide unit 65 is disposed to lie on the same side as the heat rotator 51.

As illustrated in FIG. 2 or 4, the first guide unit 61 of the decurling part 6 has guide parts to guide the sheet 9. The guide parts include an upstream guide part 62 and a bent guide part 63. The upstream guide part 62 is disposed upstream with respect to the transport direction C of the sheet 9. The bent guide part 63 is bent at an endpoint position 62*e* of the upstream guide part 62 in a direction of entry into a transport passage (the space including the area indicated by the alternate long and short dash line) of the sheet 9 relative to the upstream guide part 62.

Further, as illustrated in FIG. 2 or 4, in the decurling part 6, at least one portion of the second guide unit 65 is disposed to face the bent guide part 63 such that the at least one portion of the second guide unit 65 is positioned within an area corresponding to the portion of the bent guide part 63 from an upstream end 63*a* to a downstream end 63*b* with respect to the transport direction C of the sheet 9, with a space S being provided between the at least one portion of the second guide unit 65 and the bent guide part 63 to allow passage of the sheet 9.

As illustrated in FIG. 2 or 4, the first guide unit 61 is capable of swinging movement about a shaft 64 positioned upstream with respect to the transport direction C of the sheet 9, such that as the sheet 9 passes the bent guide part 63 while contacting the bent guide part 63, the first guide unit 61 is able to swing in a direction D1 away from the second guide unit 65 as indicated by the two-dot chain line.

At this time, the first guide unit 61 is not provided with an urging unit that urges the first guide unit 61 in the direction D1 or D2 of swinging movement, and the first guide unit 61 is disposed such that when making swinging movement away from the second guide unit 65, the first guide unit 61 swings in a direction that causes the bent guide part 63 to be lifted against gravity.

In this case, the shaft 64 is located at an end portion of the first guide unit 61 opposite from the bent guide part 63 across the upstream guide part 62. The shaft 64 is positioned in proximity to the pressure rotator 52 of the fixing part 5 and, as illustrated in FIG. 3, the shaft 64 extends in a direction substantially aligned with the longitudinal direction of the nip part FN of the fixing part 5.

Further, the upstream guide part 62 and the bent guide part 63 of the first guide unit 61 both extend in a linear manner in a direction downstream with respect to the transport direction C of the sheet 9. In this case, the relationship between the linearly-extending bent guide part 63 and the linearly-extending upstream guide part 62 is such that the bent guide part 63 is bent at a required angle toward the transport path of the sheet 9 with respect to (the extended line of) the upstream guide part 62.

The first guide unit 61 is disposed to be kept in the following state at least when the sheet 9 having undergone a fixing process is not passing the first guide unit 61 while contacting the first guide unit 61.

That is, the first guide unit 61 is disposed such that the linearly-extending upstream guide part 62 is substantially aligned with a direction defined as the transport path along which the sheet 9 is transported after leaving the nip part FN of the fixing part 5. Further, as described above, the linearly-extending bent guide part 63 of the first guide unit 61 a guide part that is bent at the endpoint position 62*e* of the upstream guide part 62 in a direction of entry into the transport passage of the sheet 9. Consequently, the bent guide part 63 crosses the above-mentioned direction defined as the transport path at a greater angle than does the upstream guide part 62. The direction defined as the transport path according to Exemplary Embodiment 1 is, for example, a direction indicated by the alternate long and short dash line in FIG. 2, that is, a direction deflected diagonally to the right from the nip part FN such that the sheet 9 travels toward the pair of the discharge rollers 46 located diagonally above and to the right of the nip part FN. In this sense, it can be said that the first guide unit 61 is a guide unit whose portion (e.g. surface) that guides the sheet 9 is recessed as a whole relative to the transport path of the sheet 9.

In the decurling part 6, at least when the sheet 9 having undergone a fixing process is not passing the upstream guide part 62 and the bent guide part 63 of the first guide unit 61 while making contact therewith, a portion of the first guide unit 61 is brought into contact with a first position-restricting unit 66A and kept at rest in that position so that the upstream guide part 62 and the upstream guide part 62 are maintained in the above-mentioned state.

The second guide unit 65 is a component having a rotary part 65*a* having the shape of a circular column or cylinder, and a shaft part 65*b*. The rotary part 65*a* rotates as the incoming sheet 9 passes the rotary part 65*a* while contacting the rotary part 65*a* after undergoing a fixing process. The shaft part 65*b* bears the rotation of the rotary part 65*a*. The shaft part 65*b* of the second guide unit 65 is rotatably mounted to, for example, a support member (not illustrated) or a portion of a stripping guide unit (67) described later.

As illustrated in FIG. 4, with respect to the linearly-extending bent guide part 63 of the first guide unit 61, the whole or a portion of the rotary part 65*a* of the second guide unit 65 is positioned to lie within the area bounded by perpendicular lines L1 and L2, which perpendicularly pass through the upstream end 63*a* and the downstream end 63*b* of the bent guide part 63, respectively. In other words, the whole or a portion of the rotary part 65*a* is positioned to lie downstream of the upstream end 63*a* of the bent guide part 63 with respect to the transport direction C of the sheet 9, and lie upstream of the downstream end 63*b* with respect to the transport direction C of the sheet 9.

From the viewpoint of causing the second guide unit 65 to function as a guide unit that guides the sheet 9 into contact with the bent guide part 63 of the first guide unit 61, it is desired that the rotary part 65*a* of the second guide unit 65 be positioned downstream of the perpendicular line L1, which perpendicularly passes through the upstream end 63*a* of the bent guide part 63, with respect to the transport direction C of the sheet 9. In Exemplary Embodiment 1, the second guide unit 65 is disposed such that the whole of the rotary part 65*a* lies within the above-mentioned area bounded between the perpendicular lines L1 and L2.

Further, the rotary part 65*a* of the second guide unit 65 is disposed with a space S provided between the rotary part 65*a* and the bent guide part 63 of the first guide unit 61 to allow passage of the sheet 9. The space S is set to such a size (separation) that, when the sheet 9 comes into contact with and passes the bent guide part 63, the sheet 9 is able to pass through the space S without jamming while being subjected to bending and guiding by the bent guide part 63.

In particular, with the decurling part 6 according to Exemplary Embodiment 1, whether the first guide unit 61 swings and the amount of such swinging movement differ in accordance with the type of the sheet 9.

That is, when the sheet 9 that is a plain paper sheet (9A) or thin paper sheet passes the bent guide part 63 of the first guide unit 61 while contacting the bent guide part 63, the first guide unit 61 does not swing in the direction D1 away from the second guide unit 65 or swings only slightly in the direction D1. When the sheet 9 that is a heavy paper sheet (9B) passes the bent guide part 63 while contacting the bent guide part 63, the first guide unit 61 swings in the direction D1 away from the second guide unit 65 by an amount corresponding to the magnitude of, for example, the rigidity of the sheet 9.

As illustrated in FIG. 3, the first guide unit 61 according to Exemplary Embodiment 1 has a configuration such that the first guide unit 61 is divided into multiple segments with respect to the longitudinal direction of the nip part FN of the fixing part 5 (or the axial direction of the pressure rotator 52), with these segments of the first guide unit 61 being mounted to the shaft 64 at predetermined intervals. In another alternative configuration of the first guide unit 61, for example, a single continuous (e.g., plate-shaped) first guide unit 61 extending in the longitudinal direction of the nip part FN may be mounted to the shaft 64.

The second guide unit 65 according to Exemplary Embodiment 1 has a configuration such that the second guide unit 65 (rotary part 65*a*) is divided into multiple segments with respect to the longitudinal direction of the nip part FN, in a manner corresponding to the segmented construction of the first guide unit 61 mentioned above. For the second guide unit 65 as well, in another alternative configuration, for example, the second guide unit 65 may be a single continuous second guide unit 65 (rotary part 65*a*) extending in the longitudinal direction of the nip part FN.

In the decurling part 6, when the first guide unit 61 (in actuality, the bent guide part 63) swings in the direction D1 away from the second guide unit 65, a portion of the first guide unit 61 is brought into contact with a second position-restricting unit 66B and kept at rest in that position, so that the first guide unit 61 is kept at rest in its maximum allowable swing position.

Further, as illustrated in FIGS. 2 to 4, the decurling part 6 includes a stripping guide unit 67 disposed between the nip part FN of the fixing part 5 and the second guide unit 65 to strip the sheet 9 from the heat rotator 51 at the exit side of the nip part FN and guide the stripped sheet 9 toward the second guide unit 65. The stripping guide unit 67 has a guide part 67*a* that extends continuously to reach the second guide unit 65.

As illustrated in FIG. 3, for example, the stripping guide unit 67 has a configuration (a baffle-like configuration) such that the guide part 67*a* is implemented as a plate-shaped member extending in the longitudinal direction of the nip part FN, and that the plate-shaped guide part 67*a* is mounted to multiple supports 67*b*. Each of the supports 67*b* supports the guide part 67*a* from the back side of the guide part 67*a*, and is positioned on either side of each corresponding segment of the second guide unit 65 having a segmented construction as mentioned above. Further, an end portion 67*c* of the guide part 67*a* located upstream with respect to the transport direction C of the sheet 9 is positioned in proximity to a portion of the outer peripheral surface of the heat rotator 51 located past the nip part FN.

Although the decurling part 6 has been described above as being separate from the fixing part 5, in another configuration, the decurling part 6 may be incorporated into the fixing part 5 as a portion of the fixing part 5.

As illustrated in FIG. 2 or other figures, in the decurling part 6, the first guide unit 61, the second guide unit 65, and the stripping guide unit 67 constitute the transport passage (space) of the discharge transport path Rt2 together with discharge guide units 47 and 48, which are disposed between each of the first guide unit 61 and the second guide unit 65 and the pair of discharge rollers 46 to guide discharge of the sheet 9.

Each of the discharge guide units 47 and 48 is implemented as a dedicated guide member, or as a guide part that also serves as a portion of another support member.

Of the two discharge guide units, the discharge guide unit 47 is disposed with a lower guide part 47*a* located between the second guide unit 65 of the decurling part 6 and one (e.g., a driven discharge roller 46*b*) of the pair of discharge rollers 46.

The discharge guide unit 48 is disposed with an upper guide part 48*a* located between the first guide unit 61 of the decurling part 6 and the other one (e.g., a driving discharge roller 46*a*) of the pair of discharge rollers 46. The discharge guide unit 48 is positioned in relation to the first guide unit 61 of the decurling part 6 such that when the first guide unit 61 swings to its maximum position in the direction D1 away from the second guide unit 65 and comes into contact with the second position-restricting unit 66B to rest in that position, the discharge guide unit 48 is able to guide the sheet 9 toward the pair of discharge rollers 46 as the sheet 9 travels past the first guide unit 61 that has undergone the swinging movement.

Operation of Decurling Part

Hereinafter, operation of the decurling part 6 will be described.

First, when the sheet 9 having undergone a fixed process is not passing through the decurling part 6, the first guide unit 61 is brought into contact with the first position-restricting unit 66A and kept at rest in that position as indicated by the solid line in FIG. 2 or 4.

That is, at this time, the first guide unit 61 tends to swing under its own weight about the shaft 64 in the direction D2 toward the second guide unit 65. However, such swinging movement is restricted as a portion of the first guide unit 61 comes into contact with the first position-restricting unit 66A.

As illustrated in FIG. 2, 4, or other figures, in this state, as the sheet 9 leaves the nip part FN of the fixing part 5, the upstream guide part 62 of the first guide unit 61 is able to guide the sheet 9 while deflecting the sheet 9 diagonally upward at an angle toward the pair of discharge rollers 46.

Further, at this time, the bent guide part 63 of the first guide unit 61 advances into the transport passage of the discharge transport path Rt2 and thus is in its closest position to the second guide unit 65. In this state, the bent guide part 63 is able to further deflect the sheet 9 relative to the upstream guide part 62 and guide the sheet 9 substantially horizontally for transport toward the pair of discharge rollers 46.

Next, the operation of the decurling part 6 when a plain paper sheet 9A is used as the sheet 9 will be described.

Figure 5A:
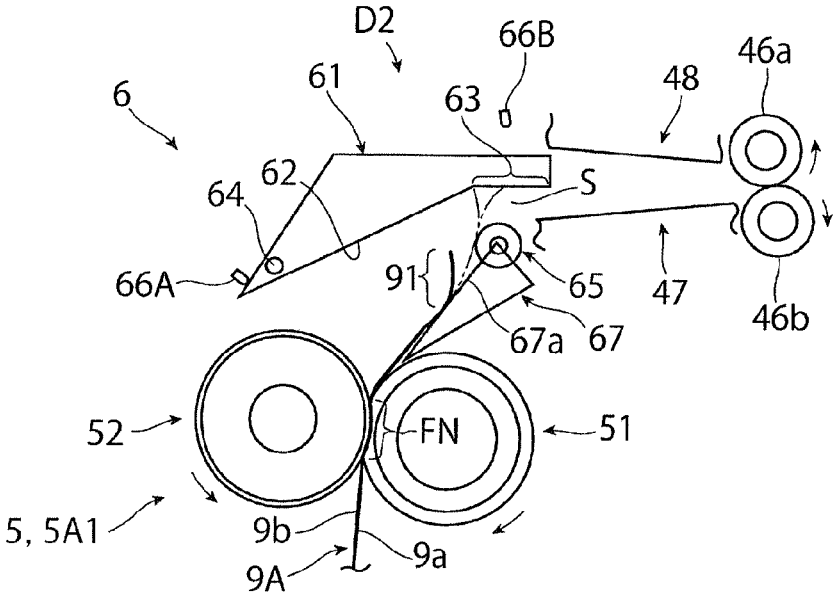
FIG. 5A schematically illustrates an operational state when a plain paper sheet leaving the fixing part illustrated in FIG. 2 is led into the decurling part illustrated in FIG. 2.

In this case, in the fixing process, the plain paper sheet 9A is discharged from the nip part FN of the fixing part 5 as illustrated in FIG. 5A and then travels to the decurling part 6.

As described above, the fixing part 5 in this case is the upward discharge-type fixing part 5A1 with type-1 nip as illustrated in FIG. 14A. Accordingly, in the fixing part 5A1, the plain paper sheet 9A carrying a transferred unfixed image passes through the nip part FN (FN1) formed by the heat rotator 51 rotating as indicated by the arrow and the pressure rotator 52 that is in pressure contact with the heat rotator 51 while biting into the surface (elastic layer 51*b*) of the heat rotator 51. The plain paper sheet 9A is then stripped from the heat rotator 51 either naturally or by the stripping action of the stripping guide unit 67, and discharged substantially upward.

As illustrated in FIG. 5A, as the plain paper sheet 9A is transported after leaving the nip part FN of the fixing part 5A1, the plain paper sheet 9A sometimes develops an away-from-image curl 91. The away-from-image curl 91 occurs as the plain paper sheet 9A is deformed into a curved shape that warps toward the back side 9*b* opposite to the front side 9*a* carrying the transferred unfixed image.

Subsequently, the plain paper sheet 9A having the away-from-image curl continues its travel under the transport force provided by the nip part FN1 of the fixing part 5A1. Then, for example, the plain paper sheet 9A is temporarily guided to the guide part 67*a* of the stripping guide unit 67 of the decurling part 6 and then travels to the second guide unit 65 of the decurling part 6. Subsequently, the plain paper sheet 9A moves so as to pass the second guide unit 65 and reach the bent guide part 63 of the first guide unit 61.

At this time, the plain paper sheet 9A travels to the bent guide part 63 as the plain paper sheet 9A is brought into contact with and guided by the upstream guide part 62, or the plain paper sheet 9A moves directly to the bent guide part 63.

Figure 5B:
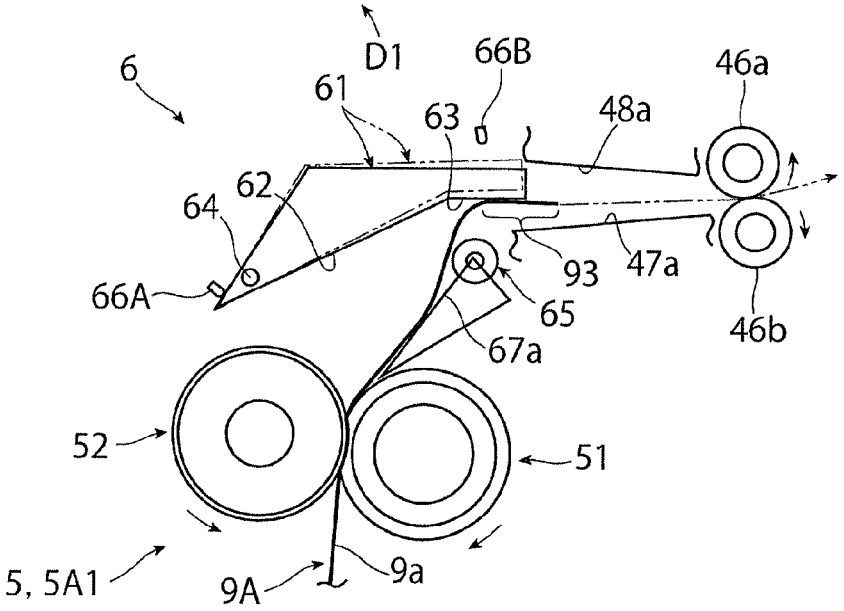
FIG. 5B conceptually illustrates an operational state when the plain paper sheet illustrated in FIG. 5A passes through the decurling part.

In the decurling part 6, as indicated by the two-dot chain line in FIG. 5A or as illustrated in FIG. 5B, as the plain paper sheet 9A with an away-from-image curl is moved to pass the bent guide part 63 of the first guide unit 61 while contacting the bent guide part 63, the plain paper sheet 9A is bent so as to warp toward the front side 9*a* at an angle substantially conforming to the angle at which the bent guide part 63 guides the plain paper sheet 9A. The portion of the plain paper sheet 9A indicated by reference numeral 93 in FIG. 5B represents the portion of the plain paper sheet 9A that is moving while being bent by the bent guide part 63.

At this time, even as the plain paper sheet 9A passes the first guide unit 61 while contacting the first guide unit 61, the first guide unit 61 is not pushed up by the plain paper sheet 9A, with its own weight overcoming any such pushing force exerted by the plain paper sheet 9A so that the first guide unit 61 is kept from swinging in the direction D1 away from the second guide unit 65. However, for example, depending on some condition such as the rigidity of the plain paper sheet 9A being relatively high, the first guide unit 61 may sometimes swing slightly in the direction D1 away from the second guide unit 65 as indicated by the two-dot chain line in FIG. 5B.

After leaving the bent guide part 63 of the first guide unit 61 in the decurling part 6, the plain paper sheet 9A is then introduced to the transport passage defined by the discharge guide units 47 and 48 as indicated by the two-dot chain line with an arrow in FIG. 5B.

Thereafter, the plain paper sheet 9A passes through the transport passage between the discharge guide units 47 and 48, either by simply moving through the transport passage or while being guided by the discharge guide units 47 and 48. The plain paper sheet 9A is then transported so as to reach the pair of discharge rollers 46 (the nip part formed by pressure contact between the driving discharge roller 46*a* and the driven discharge roller 46*b*) rotating as indicated by the arrows.

At this time, even at the point when the leading portion of the plain paper sheet 9A becomes pinched by the pair of discharge rollers 46 during its transport, the trailing portion of the plain paper sheet 9A moving through the decurling part 6 is still being bent by the bent guide part 63 of the first guide unit 61. This is due to the following reason. That is, in many cases, the speed at which the sheet 9 (9A) is transported by the heat rotator 51 and the pressure rotator 52 in the nip part FN of the fixing part 5 is set slightly higher than the speed of transport by the pair of discharge rollers 46. Consequently, the plain paper sheet 9A is transported in such a way that the amount of the plain paper sheet 9A sent out from the nip part FN of the fixing part 5 is large relative to the amount of the plain paper sheet 9A sent out from the discharge rollers 46.

Further, even at the point when the trailing end of the plain paper sheet 9A passes through the nip part FN of the fixing part 5 during its transport, the leading end portion of the plain paper sheet 9A is bent to some degree so as to warp toward the front side 9*a* during its passage through the space S between the bent guide part 63 of the first guide unit 61 and the second guide unit 65 in the decurling part 6.

As described above, in the decurling part 6, when the plain paper sheet 9A leaving the nip part FN of the fixing part 5 and having away-from-image curl passes the bent guide part 63 of the first guide unit 61, the plain paper sheet 9A is made to pass the bent guide part 63 while being temporarily bent by the bent guide part 63 into a curved shape that warps toward the front side 9*a*. This corrects the away-from-image curl in the plain paper sheet 9A so that the away-from-image curl substantially disappears.

At this time, the away-from-image curl is corrected in the decurling part 6 mostly by the bent guide part 63 of the first guide unit 61 and the second guide unit 65. The away-from-image curl is thus corrected by means of a relatively simple structure, without requiring a special operation such as controlling at least a portion of the decurling part 6 by use of a drive unit in accordance with the basis weight of the sheet 9.

Further, with the image forming apparatus 1, even when the plain paper sheet 9A develops away-from-image curl upon leaving the nip part FN of the fixing part 5, as the plain paper sheet 9A passes through the decurling part 6, the away-from-image curl in the plain paper sheet 9A is corrected. The plain paper sheet 9A is thus substantially flattened, and then received by the paper output receiving part 12 in substantially proper condition.

Next, the operation of the decurling part 6 when the heavy paper sheet 9B is used as the sheet 9 will be described.

Figure 6A:
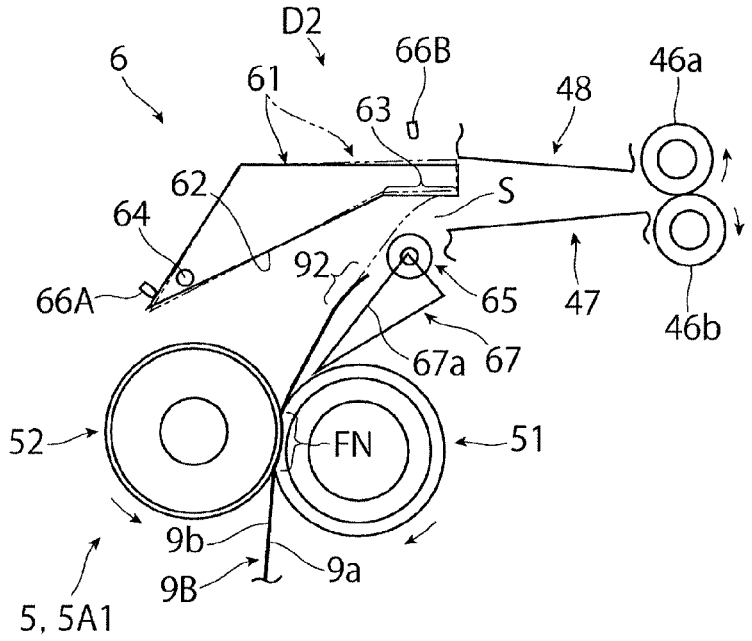
FIG. 6A schematically illustrates an operational state when a heavy paper sheet leaving the fixing part illustrated in FIG. 2 is led into the decurling part illustrated in FIG. 2.

In this case, in the fixing process, the heavy paper sheet 9B is discharged from the nip part FN of the fixing part 5 as illustrated in FIG. 6A and then travels to the decurling part 6.

As described above, the fixing part 5 in this case is the upward discharge-type fixing part 5A1 with type-1 nip. Accordingly, after the heavy paper sheet 9B carrying a transferred unfixed image passes through the nip part FN1 of the fixing part 5A1, the heavy paper sheet 9B is stripped from the heat rotator 51 either naturally or by the stripping action of the stripping guide unit 67, and is then discharged substantially upward.

At this time, as illustrated in FIG. 6A, upon leaving the nip part FN1 of the fixing part 5A1, the heavy paper sheet 9B is discharged with no away-from-image curl (91), even though the heavy paper sheet 9B has passed through the nip part FN1. However, depending on the type of the heavy paper sheet 9B being used, the heavy paper sheet 9B may sometimes be transported while having a slight toward-image curl 92, which occurs when the heavy paper sheet 9B is deformed into a curved shape that warps toward the front side 9*a* carrying the transferred unfixed image.

Subsequently, the heavy paper sheet 9B with no away-from-image curl continues its travel under the transport force provided by the nip part FN of the fixing part 5. Then, for example, the heavy paper sheet 9B travels to the second guide unit 65 of the decurling part 6 without being guided by the guide part 67*a* of the stripping guide unit 67 of the decurling part 6. Subsequently, the heavy paper sheet 9B is led by the second guide unit 65 so as to reach the bent guide part 63 of the first guide unit 61. At this time, depending on how the leading end portion of the heavy paper sheet 9B is oriented when leaving the nip part FN, the heavy paper sheet 9B may sometimes travel to the bent guide part 63 after being brought into contact with and guided by the upstream guide part 62 of the first guide unit 61.

Figure 6B:
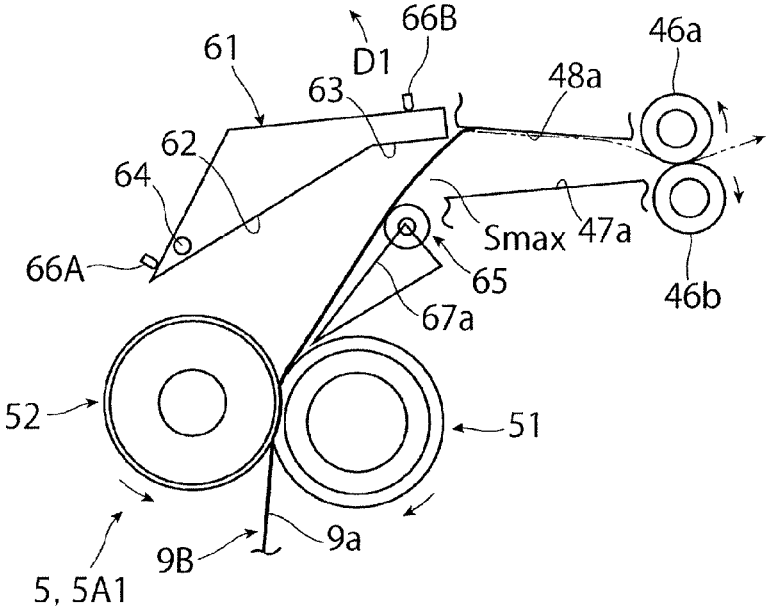
FIG. 6B conceptually illustrates an operational state when the heavy paper sheet illustrated in FIG. 6A passes through the decurling part.

As illustrated in FIG. 6B, in the decurling part 6, as the heavy paper sheet 9B with no away-from-image curl passes the bent guide part 63 of the first guide unit 61 while contacting the bent guide part 63, the bent guide part 63 is pushed by the heavy paper sheet 9B, causing the entire first guide unit 61 to swing about the shaft 64 in the direction D1 away from the second guide unit 65. The bent guide part 63 is thus lifted upward.

Consequently, in the decurling part 6, the heavy paper sheet 9B with no away-from-image curl is moved while keeping its original orientation, without undergoing bending by the bent guide part 63 of the first guide unit 61 that causes the heavy paper sheet 9B to warp toward the front side 9*a*.

At this time, as illustrated in FIG. 6B, when the first guide unit 61 swings in the above-mentioned direction D1 away from the second guide unit 65, a portion of the first guide unit 61 eventually comes into contact with the second position-restricting unit 66B to rest in that position, thus disabling further swinging movement of the first guide unit 61. As illustrated in FIG. 6B, the bent guide part 63 of the first guide unit 61 in this state defines a guide part that is situated at a level somewhat lower than the upper guide part 48*a* of the discharge guide unit 48 but is substantially continuous with the upper guide part 48*a*.

At this time, the space S between the bent guide part 63 and the second guide unit 65 in the decurling part 6 is at its maximum, Smax. However, at this time, depending on some condition such as the rigidity of the heavy paper sheet 9B being relatively low, the first guide unit 61 may sometimes swing in the direction D1 away from the second guide unit 65 only by such an amount that the first guide unit 61 does not reach the second position-restricting unit 66B.

After leaving the bent guide part 63 of the first guide unit 61 in the decurling part 6, the heavy paper sheet 9B is then introduced to the transport passage defined by the discharge guide units 47 and 48 as indicated by the two-dot chain line with an arrow in FIG. 6B.

Thereafter, the heavy paper sheet 9B passes through the transport passage between the discharge guide units 47 and 48 while being guided mostly by the upper guide part 48*a* of the discharge guide unit 48. The heavy paper sheet 9B is then transported to the pair of discharge rollers 46 (the nip part formed by pressure contact between the driving discharge roller 46*a* and the driven discharge roller 46*b*) rotating as indicated by the arrows.

During this process, the leading portion of the heavy paper sheet 9B travels toward the pair of discharge rollers 46 while being guided mostly by the upper guide part 48*a* of the discharge guide unit 48. At this time, as the leading portion of the heavy paper sheet 9B passes the upper guide part 48*a* of the discharge guide unit 48, the leading portion undergoes hardly any bending that causes its warping toward the front side 9*a*. This is due to the following reason. That is, in many cases, the speed at which the sheet 9 (9B) is transported by the heat rotator 51 and the pressure rotator 52 in the nip part FN of the fixing part 5 is set slightly higher than the speed of transport by the pair of discharge rollers 46. Consequently, the heavy paper sheet 9B is transported in such a way that the amount of the heavy paper sheet 9B sent out from the nip part FN of the fixing part 5 is large relative to the amount of the heavy paper sheet 9B sent out from the discharge rollers 46. Thus, as the heavy paper sheet 9B travels, the heavy paper sheet 9B traces a trajectory such that, for example, the heavy paper sheet 9B moves away from the second guide unit 65.

Even at the point when the trailing end of the heavy paper sheet 9B passes through the nip part FN of the fixing part 5 during its transport, the leading end portion of the heavy paper sheet 9B undergoes hardly any bending that causes warping toward the front side 9*a* during its passage through the space S between the bent guide part 63 of the first guide unit 61 and the second guide unit 65 in the decurling part 6.

Lastly, in the decurling part 6, once the heavy paper sheet 9B has moved past the bent guide part 63 of the first guide unit 61, the first guide unit 61 swings under its own weight about the shaft 64 in the direction D2 toward the second guide unit 65. The first guide unit 61 thus naturally returns to its state (FIG. 6A) before the heavy paper sheet 9B comes into contact with and passes the bent guide part 63 of the first guide unit 61.

As described above, in the decurling part 6, when the heavy paper sheet 9B leaving the nip part FN of the fixing part 5 and having no away-from-image curl passes the bent guide part 63 of the first guide unit 61 while contacting the bent guide part 63, the first guide unit 61 swings in the direction D1 away from the second guide unit 65 due to the pressing force received from the heavy paper sheet 9B. Consequently, in the decurling part 6, the heavy paper sheet 9B passes the bent guide part 63 of the first guide unit 61 substantially without being temporarily bent by the bent guide part 63 into a curved shape that warps toward the front side 9*a*.

This eliminates or reduces the risk of newly inducing away-from-image curl or toward-image curl in the heavy paper sheet 9B as the heavy paper sheet 9B passes through the decurling part 6.

Further, if the curl that the heavy paper sheet 9B develops upon leaving the nip part FN of the fixing part 5 is a toward-image curl as indicated by reference numeral 92 in FIG. 6A, the heavy paper sheet 9B is not temporarily bent so as to curve toward the front side 9*a* during its passage through the space S in the decurling part 6 or through the transport passage between the discharge guide units 47 and 48. Consequently, even if the heavy paper sheet 9B having toward-image curl passes through the decurling part 6, the decurling part 6 is not likely to exacerbate formation of the toward-image curl.

Modifications of Exemplary Embodiment 1

The decurling part 6 according to Exemplary Embodiment 1 may be modified such that the first guide unit 61 is of a stationary type that does not swing about the shaft 64 but is disposed in a stationary manner.

As opposed to the first guide unit 61 according to Exemplary Embodiment 1 that is of a swinging type, with the first guide unit 61 of a stationary type mentioned above, there is no need to provide components such as the position-restricting units 66A and 66B, and further, the away-from-image curl that is present in the sheet 9 (plain paper sheet 9A) leaving the nip part FN of the fixing part 5 is corrected by means of a simple structure.

If the first guide unit 61 of a stationary type is employed as described above, from the viewpoint of allowing even the heavy paper sheet 9B to smoothly pass through the space S between the first guide unit 61 and the second guide unit 65, it is desired, for example, to further optimize settings on features such as the size of the space S and the shape of the bent guide part 63.

The first guide unit 61 of the decurling part 6 according to Exemplary Embodiment 1 may be partially modified as illustrated in FIGS. 7A to 8B, for example.

Figure 7A:
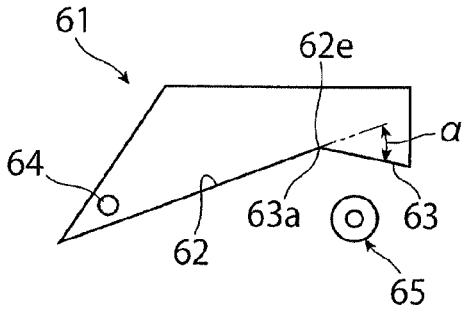
FIGS. 7A and 7B each schematically illustrate another exemplary configuration of a first guide unit with a bent guide part extending in a linear manner.

The first guide unit 61 illustrated in FIG. 7A is modified such that the linearly-extending bent guide part 63 is bent toward the transport path of the sheet 9 with respect to (the extended line of) the linearly-extending upstream guide part 62 at an angle $\alpha$ greater than the angle of bending of the bent guide part 63 according to Exemplary Embodiment 1 (see FIG. 4 or other figures).

With the first guide unit 61 according to this modification, for example, the degree of bend provided by the bent guide part 63 to the plain paper sheet 9A is greater than the degree of bend provided by the bent guide part 63 according to Exemplary Embodiment 1. Further, as the heavy paper sheet 9B passes the bent guide part 63 while contacting the bent guide part 63, the bent guide part 63 is readily lifted up in comparison to the bent guide part 63 according to Exemplary Embodiment 1.

Figure 7B:
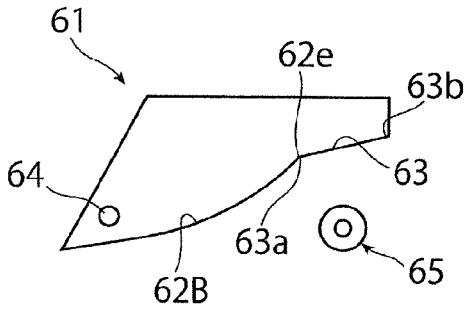

With the first guide unit 61 illustrated in FIG. 7B, the upstream guide part 62 is modified to an upstream guide part 62B extending in the shape of a curve that is convex toward the transport path of the sheet 9, and the linearly-extending bent guide part 63 is modified such that the downstream end 63*b* is located above the upstream end 63*a* with respect to the horizontal direction.

In comparison to the first guide unit 61 according to Exemplary Embodiment 1, the first guide unit 61 according to this modification helps minimize, for example, paper jams that occur as the sheet 9 undergoes excessive curving (i.e. excessive bending such that the sheet 9 is deflected) when passing the first guide unit 61.

Figure 8A:
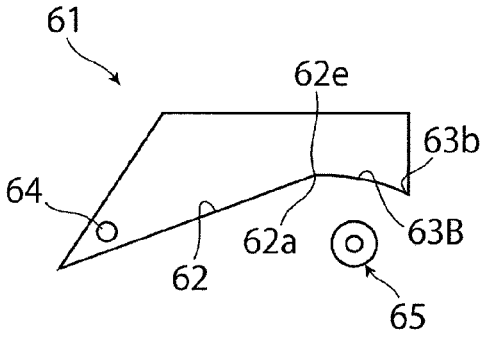
FIGS. 8A and 8B each schematically illustrate another exemplary configuration of a first guide unit with a bent guide part extended in a curved manner.

With the first guide unit 61 illustrated in FIG. 8A, the linearly-extending bent guide part 63 is modified to a curved bent guide part 63B that extends in the shape of a curve recessed in a direction away from the second guide unit 65.

According to this modification, if the first guide unit 61 is disposed in a manner that allows its swinging movement as with the first guide unit 61 according to Exemplary Embodiment 1, for example, the sheet 9 readily passes through the space S defined between the curved bent guide part 63B and the second guide unit 65. If the first guide unit 61 according to this modification is disposed in a stationary manner, for example, the sheet 9 (in particular, even if the sheet 9 is the heavy paper sheet 9B) readily passes through the space S defined between the curved bent guide part 63B and the second guide unit 65, and further, it is possible to adjust the strength of the bending applied to the sheet 9 by the curved bent guide part 63B.

Figure 8B:
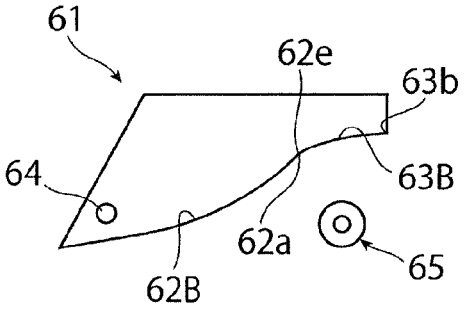

With the first guide unit 61 illustrated in FIG. 8B, the upstream guide part 62 is modified to the upstream guide part 62B extending in a curved manner as illustrated in FIG. 7B, and the bent guide part 63 is modified to the bent guide part 63B extending in a curved manner as illustrated in FIG. 8A.

With the first guide unit 61 according to this modification, if the first guide unit 61 is disposed in a manner that allows its swinging movement as with the first guide unit 61 according to Exemplary Embodiment 1, for example, the sheet 9 becomes smoothly curved as the sheet 9 passes the first guide unit 61. This helps minimize jamming of the sheet 9.

Exemplary Embodiment 2

Figure 9:
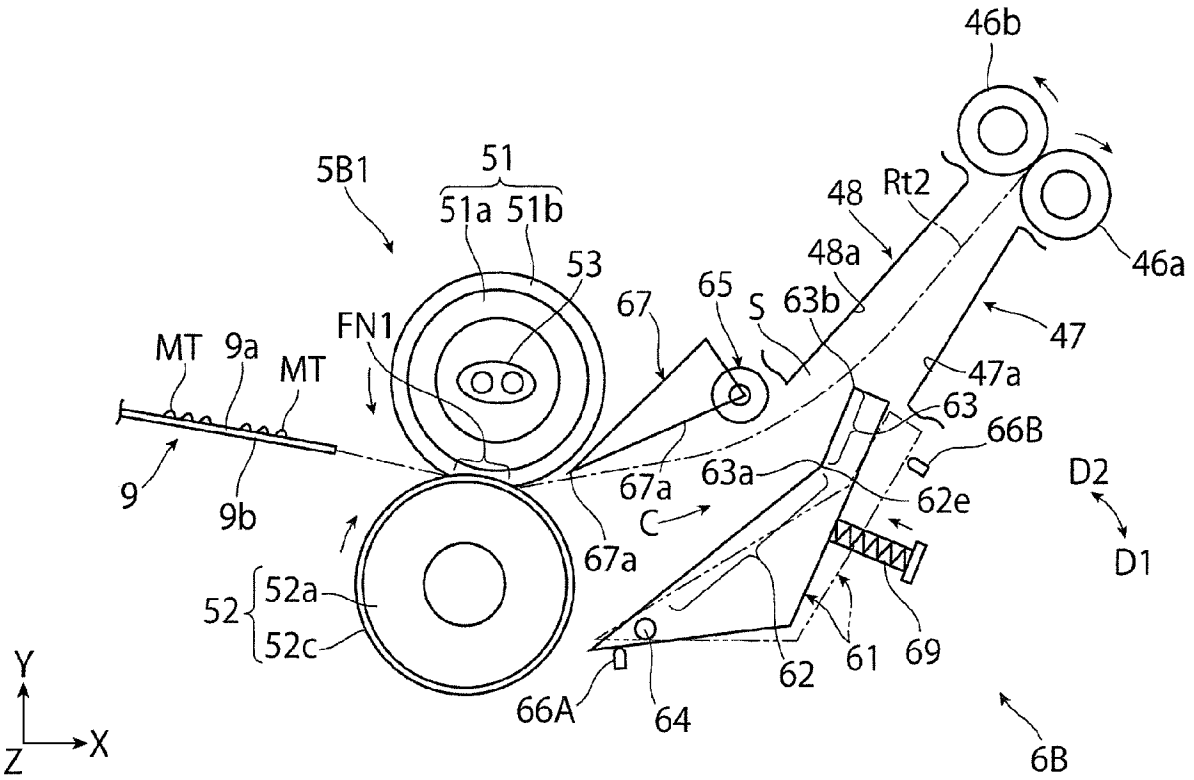
FIG. 9 schematically illustrates a fixing part and a decurling part according to Exemplary Embodiment 2.

FIG. 9 illustrates a portion (mostly a fixing part and a decurling part) of an image forming apparatus according to Exemplary Embodiment 2.

As illustrated in FIG. 9, the image forming apparatus according to Exemplary Embodiment 2 employs the fixing part 5 that, after performing a fixing process on the sheet 9, discharges the sheet 9 from the nip part FN in substantially the lateral direction (e.g., in a direction falling within a range of ±45 degrees with respect to the horizontal direction of the floor or other surfaces on which the image forming apparatus is placed). In the following description, the fixing part 5 that discharges a sheet in this manner will be sometimes also referred to as "lateral discharge-type fixing part 5B".

Since the image forming apparatus according to Exemplary Embodiment 2 employs the lateral discharge-type fixing part 5B, the image forming part 2 used is of a type that, after an image is transferred to the sheet 9, discharges the sheet 9 in substantially the lateral direction from the transfer position TP. Alternatively, instead of employing the image forming part of the above-mentioned type, the image forming apparatus according to Exemplary Embodiment 2 may employ a transport path such that the sheet 9 leaving the image forming part 2 after a transfer process is transported substantially laterally into the fixing part 5B.

Further, like the fixing part 5 according to Exemplary Embodiment 1, the lateral discharge-type fixing part 5B according to Exemplary Embodiment 2 is a fixing part with type-1 nip illustrated in FIG. 14A. Accordingly, in the following description, the above-mentioned lateral discharge-type fixing part 5B will be sometimes also referred to as "lateral discharge-type fixing part 5B1 with type-1 nip".

The image forming apparatus according to Exemplary Embodiment 2 employs, as the decurling part 6, a decurling part 6B having the configuration described below.

First, substantially like the decurling part 6 according to Exemplary Embodiment 1 (including its modifications), the decurling part 6B includes the first guide unit 61, the second guide unit 65, and the stripping guide unit 67. A particular difference of the decurling part 6B from the decurling part 6 according to Exemplary Embodiment 1 is that the first guide unit 61 is provided with an urging unit 69 that urges the first guide unit 61 such that the first guide unit 61 swings in the direction D2 toward the second guide unit 65.

As illustrated in FIG. 9, the first guide unit 61 of the decurling part 6B comes into contact with the back side 9*b* of the sheet 9 leaving the nip part FN (FN1) of the lateral discharge-type fixing part 5B to thereby guide the transport of the sheet 9. The first guide unit 61 includes the following guide parts: the linearly-extending upstream guide part 62 that extends in a linear manner in a direction downstream with respect to the transport direction C of the sheet 9; and the linearly-extending bent guide part 63 that is bent at the endpoint position 62*e* of the upstream guide part 62 in a direction of entry into the transport passage of the sheet 9, and extends in a linear manner in a direction downstream with respect to the transport direction C of the sheet 9.

As illustrated in FIG. 9, the first guide unit 61 is capable of swinging movement about the shaft 64 positioned upstream with respect to the transport direction C of the sheet 9 (at a position in proximity to the pressure rotator 52), such that as the sheet 9 passes the bent guide part 63 while contacting the bent guide part 63, the first guide unit 61 is able to swing in the direction D1 away from the second guide unit 65 as indicated by the two-dot chain line.

The second guide unit 65 of the decurling part 6B is substantially the same as the second guide unit 65 of the decurling part 6 according to Exemplary Embodiment 1 in the following respect. That is, at least one portion of the second guide unit 65 of the decurling part 6B is disposed to face the bent guide part 63 of the first guide unit 61 such that the at least one portion of the second guide unit 65 is positioned within an area corresponding to the portion of the bent guide part 63 from the upstream end 63*a* to the downstream end 63*b* with respect to the transport direction C of the sheet 9, with the space S being provided between the at least one portion of the second guide unit 65 and the bent guide part 63 to allow passage of the sheet 9.

Further, the first guide unit 61 of the decurling part 6B is disposed such that, at least when the sheet 9 having undergone a fixing process is not passing the first guide unit 61 while contacting the first guide unit 61, the linearly-extending upstream guide part 62 is substantially aligned with a direction defined as the transport path along which the sheet 9 is transported after leaving the nip part FN of the fixing part 5, and moreover, the linearly-extending bent guide part 63 crosses the direction defined as the above-mentioned transport path at a greater angle than does the upstream guide part 62. The direction defined as the transport path according to Exemplary Embodiment 2 is, for example, a direction indicated by the alternate long and short dash line in FIG. 9, that is, a direction deflected diagonally upward to the right from the nip part FN1 such that the sheet 9 travels toward the pair of the discharge rollers 46 located diagonally above and to the right of the nip part FN.

In substantially the same manner as the decurling part 6 according to Exemplary Embodiment 1, in the decurling part 6B, at least when the sheet 9 having undergone a fixing process is not passing the upstream guide part 62 and the bent guide part 63 of the first guide unit 61 while making contact therewith, a portion of the first guide unit 61 is brought into contact with the first position-restricting unit 66A and kept at rest in that position so that the upstream guide part 62 and the bent guide part 63 are maintained in the above-mentioned state.

Further, as illustrated in FIG. 9, the decurling part 6B is provided with the urging unit 69 that urges the first guide unit 61 in such a way that causes the first guide unit 61 to swing in the direction D2 toward the second guide unit 65, so that a portion of the first guide unit 61 is brought into contact with the first position-restricting unit 66A and kept at rest in that position to thereby maintain the above-mentioned state.

As illustrated in FIG. 9, the urging unit 69 is, for example, a pressing coil spring that is secured to a support frame at one and and pressed against a portion of the first guide unit 61 at the other end. When the sheet 9 having undergone a fixing process is not passing the first guide unit 61 while contacting the first guide unit 61, the urging unit 69 exerts an urging force that continues to elastically press on the first guide unit 61 to keep the first guide unit 61 at rest in contact with the first position-restricting unit 66A. By contrast, when the heavy paper sheet 9B having undergone a fixing process is passing the first guide unit 61 while contacting the first guide unit 61, the urging unit 69 exerts, on the first guide unit 61, an urging force of such a magnitude that allows the first guide unit 61 to swing in the direction D1 away from the second guide unit 65 as the first guide unit 61 is pushed by the heavy paper sheet 9B.

Alternatively, rather than the pressing coil spring mentioned above, the urging unit 69 may be, for example, a pulling coil spring exerting an urging force that continues to elastically pull the first guide unit 61 so that the first guide unit 61 is brought into contact with the first position-restricting unit 66A and kept at rest in that position.

Operation of Decurling Part

Hereinafter, operation of the decurling part 6B will be described.

First, when the sheet 9 having undergone a fixed process is not passing through the decurling part 6B, the first guide unit 61 is brought into contact with the first position-restricting unit 66A and kept at rest in that position as indicated by the solid line in FIG. 9.

That is, at this time, the first guide unit 61 tends to swing under its own weight about the shaft 64 in the direction D1 away from the second guide unit 65. However, such swinging movement is restricted as the first guide unit 61 is urged by the urging unit 69 to swing in the direction D2 toward the second guide unit 65 and come into contact with the first position-restricting unit 66A.

As illustrated in FIG. 9, in this state, as the sheet 9 is discharged substantially laterally from the nip part FN1 of the fixing part 5B1, the upstream guide part 62 of the first guide unit 61 is able to guide the sheet 9 while deflecting the sheet 9 diagonally upward toward the pair of discharge rollers 46.

Further, at this time, the bent guide part 63 of the first guide unit 61 advances into the inside of the transport passage of the discharge transport path Rt2 and thus is in its closest position to the second guide unit 65. In this state, the bent guide part 63 is able to bend the sheet 9 to curve upward from the upstream guide part 62, thus guiding the sheet 9 substantially vertically.

Next, the operation of the decurling part 6B when the plain paper sheet 9A is used as the sheet 9 will be described.

Figure 10A:
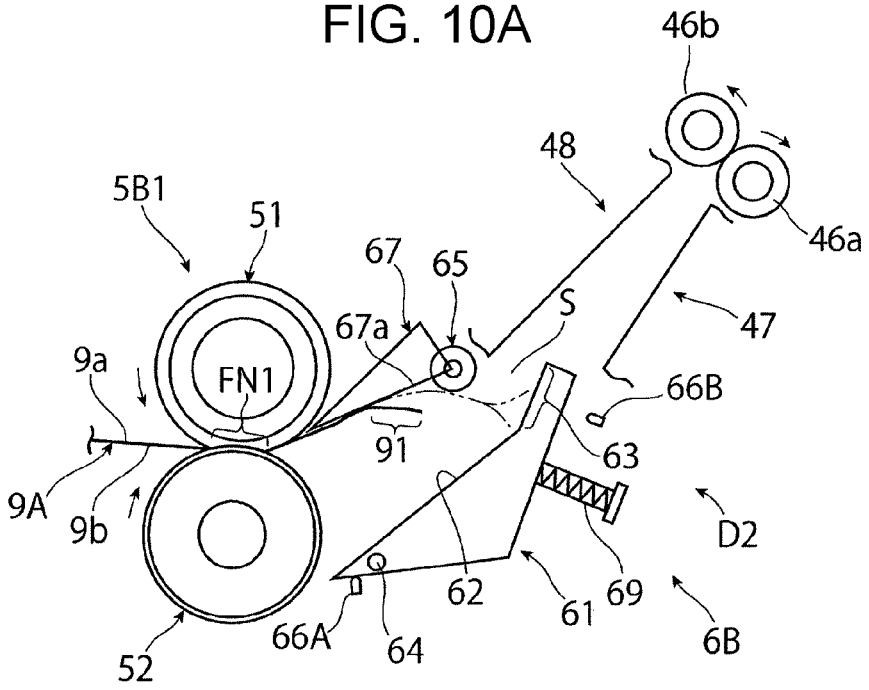
FIG. 10A schematically illustrates an operational state when a plain paper sheet leaving the fixing part illustrated in FIG. 9 is led into the decurling part illustrated in FIG. 9.

In this case, in the fixing process, the plain paper sheet 9A is discharged from the nip part FN of the fixing part 5 as illustrated in FIG. 10A and then travels to the decurling part 6.

As described above, the fixing part 5 in this case is the lateral discharge-type fixing part 5B1 with type-1 nip. Accordingly, the plain paper sheet 9A carrying a transferred unfixed image passes through the nip part FN1 of the fixing part 5B1, and is then stripped from the heat rotator 51 either naturally or by the stripping action of the stripping guide unit 67. Subsequently, the plain paper sheet 9A is discharged substantially laterally.

As illustrated in FIG. 10A, as the plain paper sheet 9A is transported after leaving the nip part FN1 of the fixing part 5B1, the plain paper sheet 9A sometimes develops the away-from-image curl 91, in substantially the same manner as the plain paper sheet 9A according to Exemplary Embodiment 1.

Subsequently, the plain paper sheet 9A having the away-from-image curl continues its travel under the transport force provided by the nip part FN1 of the fixing part 5B1. Then, in substantially the same manner as the decurling part 6 according to Exemplary Embodiment 1, the plain paper sheet 9A is temporarily guided to the guide part 67*a* of the stripping guide unit 67 of the decurling part 6B and then travels to the second guide unit 65 of the decurling part 6B. Subsequently, the plain paper sheet 9A moves so as to pass the second guide unit 65 and reach the bent guide part 63 of the first guide unit 61.

Figure 10B:
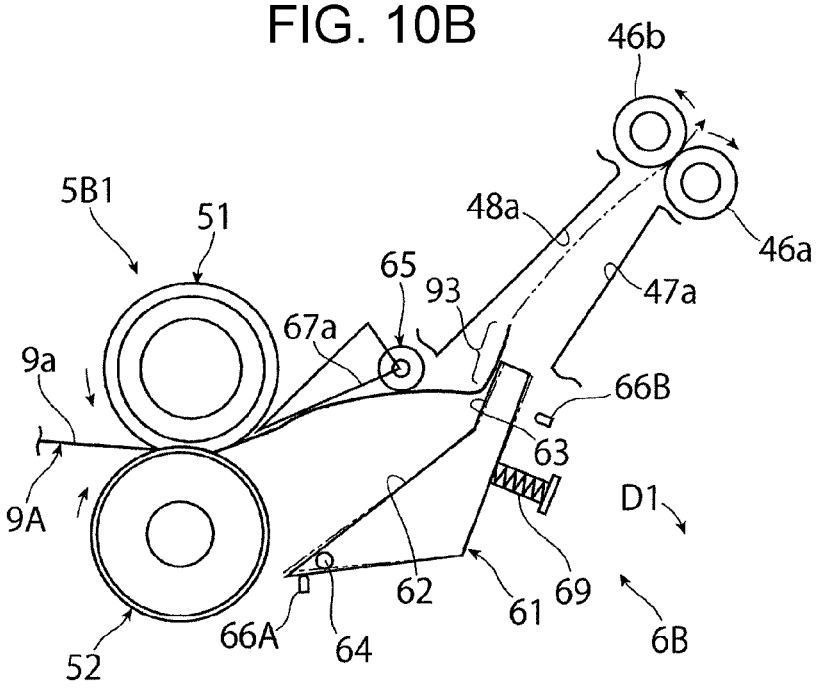
FIG. 10B schematically illustrates an operational state when the plain paper sheet illustrated in FIG. 10A passes through the decurling part.

In the decurling part 6B, as indicated by the two-dot chain line in FIG. 10A or as illustrated in FIG. 10B, as the plain paper sheet 9A with an away-from-image curl is moved to pass the bent guide part 63 of the first guide unit 61 while contacting the bent guide part 63, the plain paper sheet 9A is bent so as to warp toward the front side 9*a* at an angle substantially conforming to the angle at which the bent guide part 63 guides the plain paper sheet 9A. The portion of the plain paper sheet 9A indicated by reference numeral 93 in FIG. 10B represents the portion of the plain paper sheet 9A that is moving while being bent by the bent guide part 63.

At this time, as the plain paper sheet 9A passes the first guide unit 61 while contacting the first guide unit 61, the first guide unit 61 does not swing in the direction D1 away from the second guide unit 65 under the pressing force exerted by the plain paper sheet 9A. Rather, in this state, the urging force of the urging unit 69 keeps the first guide unit 61 swinging in the direction D2 toward the second guide unit 65. However, for example, depending on some condition such as the rigidity of the plain paper sheet 9A being relatively high, the first guide unit 61 may sometimes swing slightly in the direction D1 away from the second guide unit 65 as indicated by the two-dot chain line in FIG. 10B.

After leaving the bent guide part 63 of the first guide unit 61 in the decurling part 6B, the plain paper sheet 9A is then introduced to the transport passage defined by the discharge guide units 47 and 48 as indicated by the two-dot chain line with an arrow in FIG. 10B.

Thereafter, the plain paper sheet 9A passes through the transport passage between the discharge guide units 47 and 48, either by simply moving through the transport passage or while being guided by the discharge guide units 47 and 48.

The plain paper sheet 9A is then transported to the pair of discharge rollers 46 rotating as indicated by the arrows.

At this time, even at the point when the leading portion of the plain paper sheet 9A becomes pinched by the pair of discharge rollers 46 during its transport, for the same reason as mentioned above with reference to Exemplary Embodiment 1, the trailing portion of the plain paper sheet 9A moving through the decurling part 6B is still being bent by the bent guide part 63 of the first guide unit 61.

Further, even at the point when the trailing end of the plain paper sheet 9A passes through the nip part FN1 of the fixing part 5B1 during its transport, the leading end portion of the plain paper sheet 9A is bent to some degree so as to warp toward the front side 9*a* during its passage through the space S between the bent guide part 63 of the first guide unit 61 and the second guide unit 65 in the decurling part 6B.

As described above, in the decurling part 6B, when the plain paper sheet 9A leaving the nip part FN1 of the fixing part 5B1 and having away-from-image curl passes the bent guide part 63 of the first guide unit 61, the plain paper sheet 9A is made to pass the bent guide part 63 while being temporarily bent by the bent guide part 63 into a curved shape that warps toward the front side 9*a*. This corrects the away-from-image curl in the plain paper sheet 9A so that the away-from-image curl substantially disappears.

At this time, the away-from-image curl is corrected in the decurling part 6B mostly by the bent guide part 63 of the first guide unit 61 and the second guide unit 65. The away-from-image curl is thus corrected by means of a relatively simple structure.

Next, the operation of the decurling part 6B when the heavy paper sheet 9B is used as the sheet 9 will be described.

Figure 11A:
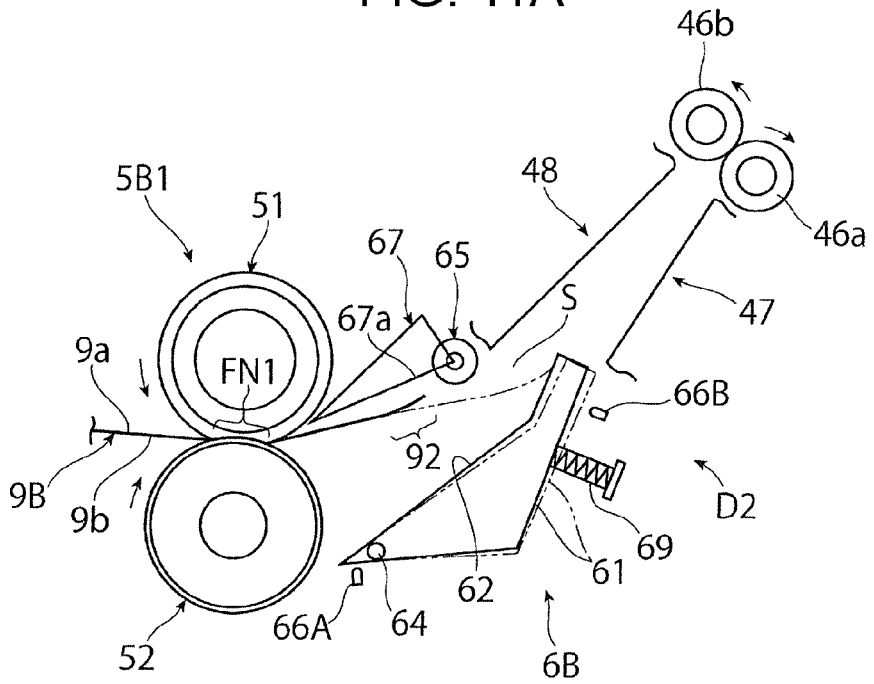
FIG. 11A schematically illustrates an operational state when a heavy paper sheet leaving the fixing part illustrated in FIG. 9 is led into the decurling part illustrated in FIG. 9.

In this case, in the fixing process, the heavy paper sheet 9B is discharged from the nip part FN1 of the fixing part 5B1 as illustrated in FIG. 11A and then travels to the decurling part 6B.

At this time, after the heavy paper sheet 9B carrying a transferred unfixed image passes through the nip part FN1 of the lateral discharge-type fixing part 5B1 with type-1 nip as described above, the heavy paper sheet 9B is stripped from the heat rotator 51 either naturally or by the stripping action of the stripping guide unit 67, and is then discharged substantially laterally.

At this time, as illustrated in FIG. 11A, upon leaving the nip part FN1 of the fixing part 5B1, the heavy paper sheet 9B is discharged with no away-from-image curl (91), even though the heavy paper sheet 9B has passed through the nip part FN1. However, depending on the type of the heavy paper sheet 9B being used or other factors, the heavy paper sheet 9B may sometimes be transported while having a slight toward-image curl (92).

Subsequently, the heavy paper sheet 9B with no away-from-image curl continues its travel under the transport force provided by the nip part FN1 of the fixing part 5B1. Then, in substantially the same manner as the heavy paper sheet 9B according to Exemplary Embodiment 1, for example, the heavy paper sheet 9B travels to the second guide unit 65 of the decurling part 6B, with or without guiding provided by the guide part 67*a* of the stripping guide unit 67 of the decurling part 6B. Subsequently, the heavy paper sheet 9B is led by the second guide unit 65 so as to reach the bent guide part 63 of the first guide unit 61.

Figure 11B:
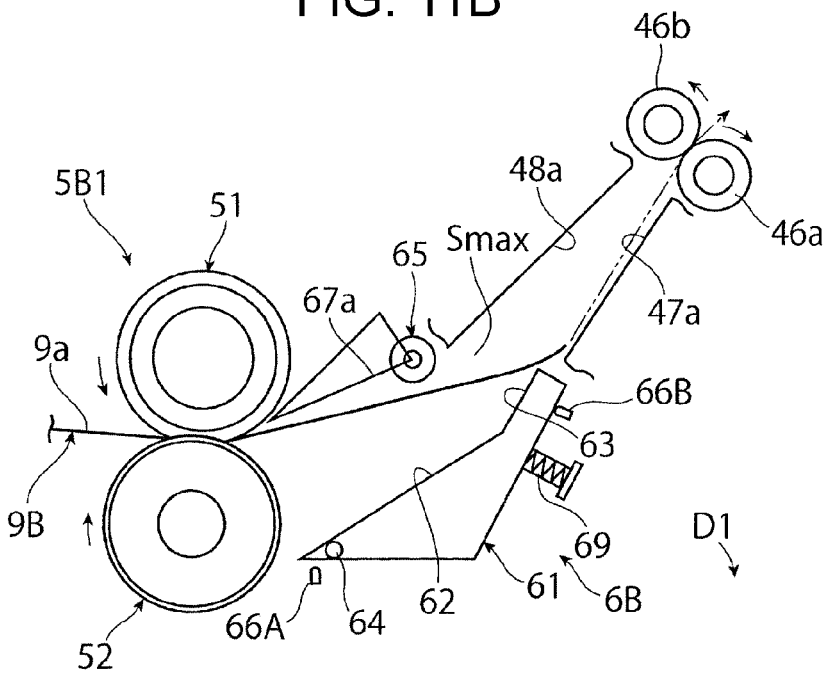
FIG. 11B schematically illustrates an operational state when the heavy paper sheet illustrated in FIG. 11A passes through the decurling part.

As illustrated in FIG. 11B, in the decurling part 6B, as the heavy paper sheet 9B with no away-from-image curl passes the bent guide part 63 of the first guide unit 61 while contacting the bent guide part 63, the bent guide part 63 is pushed by the heavy paper sheet 9B. This causes the entire first guide unit 61 to swing in the direction D1 away from the second guide unit 65 against the urging force of the urging unit 69, so that the bent guide part 63 is substantially retracted from inside the transport path.

Consequently, in the decurling part 6B, the heavy paper sheet 9B with no away-from-image curl is moved while keeping its original orientation, without undergoing bending by the bent guide part 63 of the first guide unit 61 that causes the heavy paper sheet 9B to warp toward the front side 9*a*.

At this time, as illustrated in FIG. 11B, when the first guide unit 61 swings in the above-mentioned direction D1 away from the second guide unit 65, a portion of the first guide unit 61 eventually comes into contact with the second position-restricting unit 66B to rest in that position, thus disabling further swinging movement of the first guide unit 61. As illustrated in FIG. 11B, in this state, the bent guide part 63 of the first guide unit 61 defines a guide part that is situated at a level somewhat higher than the lower guide part 47*a* of the discharge guide unit 47 but is substantially continuous with the lower guide part 47*a*.

At this time, the space S between the bent guide part 63 and the second guide unit 65 in the decurling part 6B is at its maximum, Smax. However, as in the case of the heavy paper sheet 9B according to Exemplary Embodiment 1, at this time, the first guide unit 61 may sometimes swing in the direction D1 away from the second guide unit 65 only by such an amount that the first guide unit 61 does not reach the second position-restricting unit 66B.

After leaving the bent guide part 63 of the first guide unit 61 in the decurling part 6B, the heavy paper sheet 9B is then introduced to the transport passage defined by the discharge guide units 47 and 48 as indicated by the two-dot chain line with an arrow in FIG. 11B.

Thereafter, the heavy paper sheet 9B passes through the transport passage between the discharge guide units 47 and 48 while being guided mostly by the lower guide part 47*a* of the discharge guide unit 47. The heavy paper sheet 9B is then transported to the pair of discharge rollers 46 rotating as indicated by the arrows.

During this process, the leading portion of the heavy paper sheet 9B travels toward the pair of discharge rollers 46 while being guided mostly by the lower guide part 47*a* of the discharge guide unit 47. At this time, for the same reason as mentioned above with reference to Exemplary Embodiment 1, as the leading portion of the heavy paper sheet 9B passes the lower guide part 47*a* of the discharge guide unit 47, the leading portion undergoes hardly any bending that causes its warping toward the front side 9*a*.

Even at the point when the trailing end of the heavy paper sheet 9B passes through the nip part FN1 of the fixing part 5B1 during its transport, the leading end portion of the heavy paper sheet 9B undergoes hardly any bending that causes warping toward the front side 9*a* during its passage through the space S between the bent guide part 63 of the first guide unit 61 and the second guide unit 65 in the decurling part 6B.

Lastly, in the decurling part 6B, once the heavy paper sheet 9B has moved past the bent guide part 63 of the first guide unit 61, the first guide unit 61 swings under the urging force of the urging unit 69 about the shaft 64 in the direction D2 toward the second guide unit 65. The first guide unit 61 thus naturally returns to its state (FIG. 11A) before the heavy paper sheet 9B comes into contact with and passes the bent guide part 63 of the first guide unit 61.

As described above, in the decurling part 6B, when the heavy paper sheet 9B leaving the nip part FN1 of the fixing part 5B1 and having no away-from-image curl passes the bent guide part 63 of the first guide unit 61 while contacting the bent guide part 63, the first guide unit 61 swings, due to the pressing force received from the heavy paper sheet 9B, in the direction D1 away from the second guide unit 65 against the urging force of the urging unit 69. Consequently, in the decurling part 6B, the heavy paper sheet 9B passes the bent guide part 63 of the first guide unit 61 substantially without being temporarily bent by the bent guide part 63 into a curved shape that warps toward the front side 9*a*.

This eliminates or reduces the risk of newly inducing away-from-image curl or toward-image curl in the heavy paper sheet 9B as the heavy paper sheet 9B passes through the decurling part 6B.

Further, if the curl that the heavy paper sheet 9B develops upon leaving the nip part FN1 of the fixing part 5B1 is a toward-image curl as indicated by reference numeral 92 in FIG. 11A, the heavy paper sheet 9B is not temporarily bent so as to curve toward the front side 9*a* during its passage through the space S in the decurling part 6B or through the transport passage between the discharge guide units 47 and 48. Consequently, even if the heavy paper sheet 9B having toward-image curl passes through the decurling part 6B, the decurling part 6B is not likely to exacerbate formation of the toward-image curl.

Other Modifications

The present disclosure is by no means limited to the details set forth in Exemplary Embodiments 1 and 2 above but includes, for example, the following modifications in its scope.

As illustrated in FIG. 12, the image forming apparatus 1 according to Exemplary Embodiment 1 may employ, instead of the fixing part 5, an upward discharge-type fixing part 5A2 with type-2 nip illustrated in FIG. 14B.

As illustrated in FIG. 12, a decurling part 6C used when the upward discharge-type fixing part 5A2 with type-2 nip is employed includes the first guide unit 61, the second guide unit 65, and the stripping guide unit 67, substantially like the decurling part 6 according to Exemplary Embodiment 1 (including its modifications).

However, the decurling part 6C differs from the decurling part 6 according to Exemplary Embodiment 1 in that the first guide unit 61 is disposed to lie mostly on the same side as the heat rotator 51 with respect to the nip part FN2 of the fixing part 5A2, and that the second guide unit 65 and the stripping guide unit 67 are disposed to lie on the same side as the pressure rotator 52 of the fixing part 5A2.

With the image forming apparatus employing the upward discharge-type fixing part 5A2 with type-2 nip, if the plain paper sheet 9A is used as the sheet 9, the plain paper sheet 9A leaving the nip part FN2 of the fixing part 5A2 may sometimes develop a toward-image curl 93 as indicated by the thick two-dot chain line in FIG. 12.

At this time, in the decurling part 6C, the plain paper sheet 9A leaving the nip part FN2 of the fixing part 5A2 and having the toward-image curl is made to pass the bent guide part 63 of the first guide unit 61 in the following manner. That is, in substantially the same manner as the decurling part 6 according to Exemplary Embodiment 1, the plain paper sheet 9A passes the bent guide part 63 while being temporarily bent by the bent guide part 63 into a curved shape that warps toward the back side 9*b* of the plain paper sheet 9A. This corrects the toward-image curl in the plain paper sheet 9A so that the toward-image curl substantially disappears.

If the heavy paper sheet 9B is used as the sheet 9, the decurling part 6C operates in substantially the same manner as the decurling part 6 according to Exemplary Embodiment 1.

Figure 13:
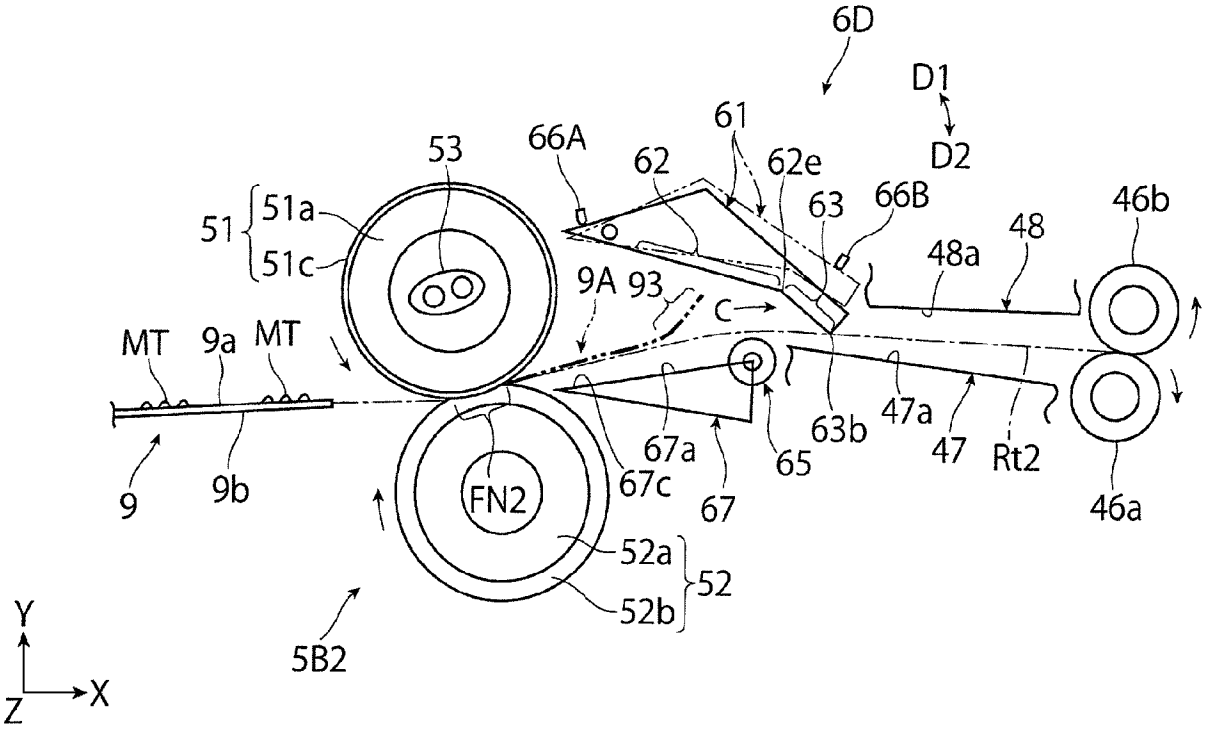
FIG. 13 schematically illustrates still another exemplary configuration of a fixing part and a decurling part.

As illustrated in FIG. 13, the image forming apparatus according to Exemplary Embodiment 2 may employ, instead of the fixing part 5, a lateral discharge-type fixing part 5B2 with type-2 nip.

As illustrated in FIG. 13, substantially like the decurling part 6B according to Exemplary Embodiment 2, a decurling part 6D employing the lateral discharge-type fixing part 5B2 with type-2 nip includes the first guide unit 61, the second guide unit 65, and the stripping guide unit 67.

However, the decurling part 6D differs from the decurling part 6B according to Exemplary Embodiment 2 in the following respects: the first guide unit 61 is disposed to lie mostly on the same side as the heat rotator 51 with respect to the nip part FN2 of the fixing part 5B2; the second guide unit 65 and the stripping guide unit 67 are disposed to lie on the same side as the pressure rotator 52 of the fixing part 5B2; and the urging unit 69 is not provided.

In the decurling part 6D, for example, from the viewpoint of reducing the friction of contact with the sheet 9, the downstream end 63*b* of the bent guide part 63 of the first guide unit 61 may be rounded into a curved shape, or a rotator such as a roller may be disposed at the downstream end 63*b*.

With the image forming apparatus employing the lateral discharge-type fixing part 5B2 with type-2 nip, if the plain paper sheet 9A is used as the sheet 9, the plain paper sheet 9A leaving the nip part FN2 of the fixing part 5B2 may sometimes develop the toward-image curl 93 as indicated by the thick two-dot chain line in FIG. 13.

At this time, in the decurling part 6D, the plain paper sheet 9A leaving the nip part FN2 of the fixing part 5B2 and having the toward-image curl is made to pass the bent guide part 63 of the first guide unit 61 in the following manner. That is, in substantially the same manner as the decurling part 6B according to Exemplary Embodiment 2, the plain paper sheet 9A passes the bent guide part 63 while being temporarily bent by the bent guide part 63 into a curved shape that warps toward the back side 9*b* of the plain paper sheet 9A. This corrects the toward-image curl in the plain paper sheet 9A so that the toward-image curl substantially disappears.

If the heavy paper sheet 9B is used as the sheet 9, the decurling part 6D operates in substantially the same manner as the decurling part 6B according to Exemplary Embodiment 2.

Further, although the image forming apparatus 1 according to each of Exemplary Embodiments 1 and 2 mentioned above includes the image forming part 2 that forms a monochrome image by use of developer, the image forming apparatus 1 may be an image forming apparatus including the image forming part 2 that forms a multi-color image. The above-mentioned image forming part 2 that forms a multi-color image may be, for example, an image forming part having a body portion that forms unfixed images of various colors, and an intermediate transfer portion used for a first transfer process and a second transfer process, the first transfer process transferring each unfixed image onto the intermediate transfer portion, the second transfer process transferring each transferred unfixed image carried by the intermediate transfer portion to the sheet.

In the foregoing description of Exemplary Embodiments 1 and 2, the fixing part 5 includes the heat rotator 51 and the pressure rotator 52 that are of a roller type. Alternatively, the fixing part 5 may have a configuration such that one or both of the heat rotator 51 and the pressure rotator 52 are of a belt-support roller type or of a belt-nip type.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a fixing unit, comprising a first fixing surface and a second fixing surface, that transports a sheet of paper carrying an unfixed image through a nip part, which is an area where the first fixing surface and the second fixing surface contact each other, to fix the unfixed image to the sheet, the nip part applying heat and pressure to the sheet;

a first guide unit, having a first guide surface, that guides transport of the sheet, the first guide unit coming into contact with a first side of the sheet leaving the nip part of the fixing unit; and a second guide unit, having a second guide surface, that guides transport of the sheet, the second guide unit coming into contact with a second side of the sheet leaving the nip part of the fixing unit, the second guide unit being rotatable, the second side being opposite to the first side, wherein the first guide unit has a guide part, the guide part including an upstream guide part, having a guide surface, disposed upstream with respect to a sheet transport direction, and a bent guide part, having a guide surface, that is bent at an endpoint position of the upstream guide part in a direction of entry into a sheet transport passage relative to the upstream guide part, wherein at least one portion of the second guide unit is disposed to face the bent guide part such that the at least one portion of the second guide unit is positioned within an area corresponding to a portion of the bent guide part from an upstream end to a downstream end with respect to the sheet transport direction, with a space being provided between the at least one portion of the second guide unit and the bent guide part to allow passage of the sheet, and wherein the first guide unit is capable of swinging movement about a shaft positioned upstream with respect to the sheet transport direction, such that as the sheet passes the bent guide part while contacting the bent guide part, the first guide unit is able to swing in a direction away from the second guide unit.

2. The image forming apparatus according to claim 1, wherein the first guide unit is disposed in a stationary manner.

3. The image forming apparatus according to claim 2, wherein the bent guide part of the first guide unit extends in a linear manner in a direction downstream with respect to the sheet transport direction.

4. The image forming apparatus according to claim 3, further comprising a stripping guide unit that is disposed between the nip part of the fixing unit and the second guide unit to strip the sheet at an exit side of the nip part and guide the stripped sheet toward the second guide unit.

5. The image forming apparatus according to claim 2, wherein the bent guide part of the first guide unit extends in a curved manner in a direction downstream with respect to the sheet transport direction.

6. The image forming apparatus according to claim 5, further comprising a stripping guide unit that is disposed between the nip part of the fixing unit and the second guide unit to strip the sheet at an exit side of the nip part and guide the stripped sheet toward the second guide unit.

7. The image forming apparatus according to claim 2, further comprising a stripping guide unit that is disposed between the nip part of the fixing unit and the second guide unit to strip the sheet at an exit side of the nip part and guide the stripped sheet toward the second guide unit.

8. The image forming apparatus according to claim 1, wherein the bent guide part of the first guide unit extends in a linear manner in a direction downstream with respect to the sheet transport direction.

9. The image forming apparatus according to claim 8, further comprising a stripping guide unit that is disposed between the nip part of the fixing unit and the second guide unit to strip the sheet at an exit side of the nip part and guide the stripped sheet toward the second guide unit.

10. The image forming apparatus according to claim 1, wherein the bent guide part of the first guide unit extends in a curved manner in a direction downstream with respect to the sheet transport direction.

11. The image forming apparatus according to claim 10, further comprising a stripping guide unit that is disposed between the nip part of the fixing unit and the second guide unit to strip the sheet at an exit side of the nip part and guide the stripped sheet toward the second guide unit.

12. The image forming apparatus according to claim 1, wherein the first guide unit is not provided with an urging unit that urges the first guide unit in a direction of swinging movement, and when the first guide unit makes swinging movement away from the second guide unit, the first guide unit swings in a direction that causes the bent guide part to be lifted against gravity.

13. The image forming apparatus according to claim 12, further comprising a stripping guide unit that is disposed between the nip part of the fixing unit and the second guide unit to strip the sheet at an exit side of the nip part and guide the stripped sheet toward the second guide unit.

14. The image forming apparatus according to claim 1, wherein the first guide unit includes an urging unit that urges the first guide unit to swing in a direction that causes the bent guide part to approach the second guide unit, and when the first guide unit makes swinging movement away from the second guide unit, the first guide unit swings in a direction that causes the bent guide part to be pushed down without resisting gravity.

15. The image forming apparatus according to claim 14, further comprising a stripping guide unit that is disposed between the nip part of the fixing unit and the second guide unit to strip the sheet at an exit side of the nip part and guide the stripped sheet toward the second guide unit.

16. The image forming apparatus according to claim 1, further comprising a stripping guide unit that is disposed between the nip part of the fixing unit and the second guide unit to strip the sheet at an exit side of the nip part and guide the stripped sheet toward the second guide unit.

17. The image forming apparatus according to claim 16, wherein the stripping guide unit has a guide part that extends to reach the second guide unit.

* * * * *